US011673641B2

(12) United States Patent
Todter et al.

(10) Patent No.: US 11,673,641 B2
(45) **Date of Patent: *Jun. 13, 2023**

(54) SUBMERGED SAILING VESSEL

(71) Applicant: SubSeaSail LLC, San Diego, CA (US)

(72) Inventors: Chris Todter, San Diego, CA (US); Mark Timothy Ott, El Cajon, CA (US); Michael B. Jones, San Diego, CA (US)

(73) Assignee: SubSeaSail LLC, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/533,583

(22) Filed: Nov. 23, 2021

(65) Prior Publication Data

US 2022/0081084 A1 Mar. 17, 2022

Related U.S. Application Data

(62) Division of application No. 16/550,915, filed on Aug. 26, 2019, now Pat. No. 11,180,232, which is a division of application No. 16/014,860, filed on Jun. 21, 2018, now Pat. No. 10,399,652, which is a (Continued)

(51) Int. Cl.

| | |
|---|---|
| ***B63H 9/061*** | (2020.01) |
| ***B63G 8/08*** | (2006.01) |
| ***B63B 1/10*** | (2006.01) |
| ***B63B 39/00*** | (2006.01) |
| ***B63B 39/02*** | (2006.01) |
| ***B63B 43/06*** | (2006.01) |
| ***B63G 8/00*** | (2006.01) |
| ***B63G 8/22*** | (2006.01) |

(Continued)

(52) U.S. Cl.

CPC ..... *B63H 9/061* (2020.02); *B63B 1/107* (2013.01); *B63B 39/00* (2013.01); *B63B 39/02* (2013.01); *B63B 43/06* (2013.01); *B63G 8/00* (2013.01); *B63G 8/08* (2013.01); *B63G 8/22* (2013.01); *B63H 9/04* (2013.01); *B63H 9/0615* (2020.02); *B63B 2035/009* (2013.01)

(58) Field of Classification Search

CPC ..... B63H 9/061; B63H 9/0615; B63H 9/04; B63B 1/107; B63B 39/00; B63B 39/02; B63B 43/06; B63B 2035/009; B63B 8/00; B63B 8/08; B63B 8/22; B63G 8/00; B63G 8/08; B63G 8/22

See application file for complete search history.

(56) References Cited

U.S. PATENT DOCUMENTS 10,029,773 B1 * 7/2018 Todter ..... B63H 9/061
11,180,232 B2 * 11/2021 Todter ..... B63B 1/107

FOREIGN PATENT DOCUMENTS

WO WO-2015038182 A2 * 3/2015 ..... B63B 15/00

* cited by examiner

*Primary Examiner* — Stephen P Avila
(74) *Attorney, Agent, or Firm* — Thibault Patent Group

(57) ABSTRACT

Various embodiments of a submerged submersible sailing vessel are disclosed. Such a submerged sailing vessel may comprise a submersible hull assembly, a keel coupled to and extending upwards from hull assembly towards a water surface, and a wind-catching assembly coupled to and extending upwards into the air from the keel for propelling the submerged sailing vessel. The hull assembly and the keel are submerged below the water surface as the vessel is propelled by the wind-catching assembly above the water surface.

20 Claims, 16 Drawing Sheets

Related U.S. Application Data division of application No. 15/645,831, filed on Jul. 10, 2017, now Pat. No. 10,029,773.

(60) Provisional application No. 62/500,368, filed on May 2, 2017.

(51) Int. Cl.
*B63H 9/04* (2020.01)
*B63B 35/00* (2020.01)

SUBMERGED SAILING VESSEL

CROSS REFERENCE TO RELATED APPLICATIONS

The present application is a divisional of U.S. patent application Ser. No. 16/550,915, filed on Aug. 26, 2019, which is a divisional of U.S. patent application Ser. No. 16/014,860 filed on Jun. 21, 2018, which is a divisional of U.S. patent application Ser. No. 15/645,831 filed on Jul. 10, 2017, now U.S. Pat. No. 10,029,773, which claims priority to provisional application No. 62/500,368 filed on May 2, 2017, all of which are assigned to the assignee hereof and hereby expressly incorporated by reference herein.

BACKGROUND

Field of Use

The present application relates to the maritime industry. More specifically, the present application relates to sailing vessels.

Description of the Related Art

Sailing vessels have been around for hundreds if not thousands of years. They universally comprise a vessel that is propelled by the wind on the surface of water. The propelling force on a vessel is provided by a wind catching mechanism in the form of a sail, wing, rotating propeller, etc. This wind can propel the vessel downwind very simply by virtue of the drag of the wind catching mechanism. However, if it is desired to proceed in a direction at least partially into the wind, then the wind catching mechanism must have the hydrodynamic property of lift, which generates a force perpendicular to the direction of the apparent wind. This lift can be utilized to make the vessel go forward partially into the wind, however this lift also generates a sideways force on the vessel, as well as a rolling moment along a longitudinal axis of the vessel. If the vessel is not to simply slip sideways under the influence of the side force, then it must resist this force. This can be accomplished in a rudimentary manner by virtue of some advantageous shaping of the vessel itself. Alternately, and much more efficiently, this is done with the use of a keel, which is typically an appendage to the vessel, that has its own hydrodynamic property of lift and thus when the vessel is moving, will generate an equal and opposite side force to the wind, thus enabling the vessel to go upwind instead of slipping sideways.

As mentioned above, the wind also generates a rolling moment which attempts to roll the boat about its longitudinal axis from bow to stern. This is due to the fact that there is the aerodynamic lift force generated by the wind on the wind catching mechanism, and it is located above the water, so the force becomes a moment which must also be resisted, or the vessel will roll over and capsize. This roll resistance is accomplished in traditional sailing vessels by virtue of the fact that there is a center of gravity of the vessel which is displaced laterally from the center of buoyancy when the vessel rolls, and this displacement provides a counter rolling moment, known as a righting moment. Typically, this approach is manifested in a vessel which has a center of gravity lower in the water than its center of buoyancy, and therefore when it is rolled somewhat, the center of buoyancy moves laterally and then provides a restoring moment when coupled with the center of gravity. This can be seen in a myriad of forms of current sailing vessels. Alternately, in a multihull vessel, the righting moment is provided by virtue of the fact that the center of gravity of the vessel is raised above the water by the force of the wind, and therefore there is a restoring righting moment between the center of gravity and the center of buoyancy in the outboard hull.

There are several disadvantages of traditional sailing vessels. First, because vessels float on top of the water, a drag is induced on the vessel due to the hullform being driven through the water and thus creating waves on the surface (a wake).

Second, surface vessels experience instability as waves, swells and wind act upon their hulls.

Third, the shape of surface vessels must generally be chosen to minimize the wave-making drag described above. Typically, this results in vessels that are necessarily slender and somewhat cylindrical in its wetted sectional shape. It is inefficient to stray from this design.

Fourth, the side force generated by a keel always acts to increase the rolling moment caused by the lift effect of the wind on the wind catching mechanism, because the method of generating the side force necessarily lies below the vessel's hull. This sideforce generation below the water surface produces a couple with the sideforce being generated by the wind above the water and the magnitude of the couple is now increased to encompass distance between the center of effort of the wind sideforce and the center of effort of the keel's opposing side force, thus acting cumulatively on the rolling moment created by the wind.

It would be desirable, therefore, to design a new type of sailing vessel that overcomes the disadvantages noted above.

SUMMARY

The embodiments described herein relate to a sailing vessel having a hull and a keel submerged under water, propelled by a wind-catching assembly above water. In one embodiment, the sailing vessel comprises a submersible hull assembly, a keel coupled to and extending upwards from the hull assembly, and a wind-catching assembly coupled to and extending upwards from the keel for propelling the hull assembly underwater.

In another embodiment, a wind-powered attachment for an under-water vessel is described, comprising a wind-catching assembly coupled to and extending upwards from the keel for propelling the hull assembly underwater, a keel coupled to and extending upwards from the hull assembly, and means for coupling the keel to the under-water vessel.

BRIEF DESCRIPTION OF THE DRAWINGS

The features, advantages, and objects of the embodiments of the present invention will become more apparent from the detailed description as set forth below, when taken in conjunction with the drawings in which like referenced characters identify correspondingly throughout, and wherein.

DETAILED DESCRIPTION

The present application describes various embodiments of a submerged sailing vessel. Generally, a submerged sailing vessel comprises a hull assembly, a keel coupled to and extending upwards from hull assembly towards a water surface, and a wind-catching assembly coupled to the keel for propelling the submerged sailing vessel. Unlike traditional sailing vessels, the hull assembly and keel are submerged below a water surface as the vessel is propelled by the wind-catching assembly above the water surface.

Figure 1A:
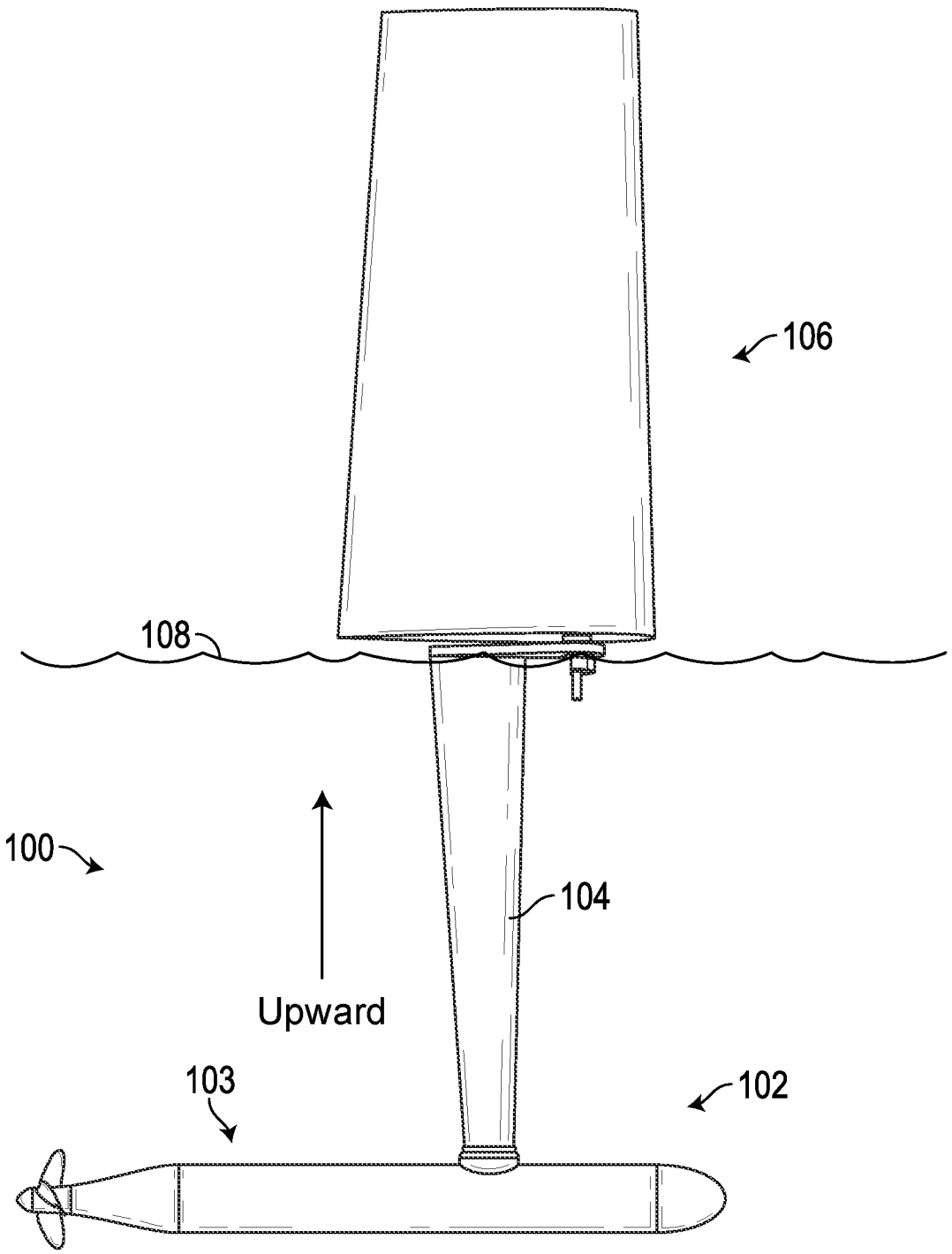
FIG. 1A is a perspective view of one embodiment of a submerged sailing vessel (SSV)
Figure 1B:
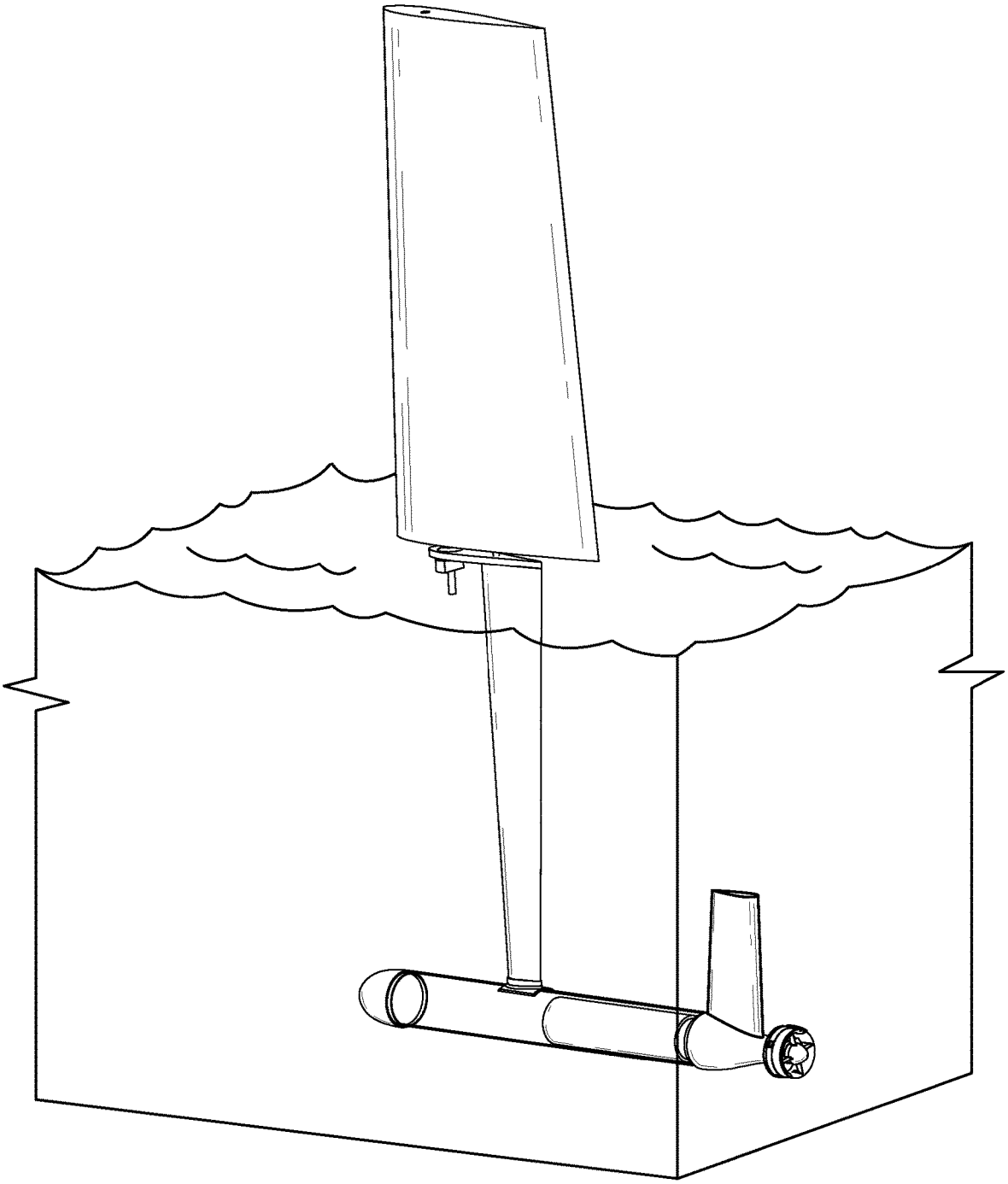
FIG. 1B is another perspective view of the submerged sailing vessel as shown in FIG. 1 as it would appear being propelled underwater by an above-water, wind-catching assembly.

FIG. 1A is a perspective view of one embodiment of a submerged sailing vessel (SSV) 100, comprising hull assembly 102, and a keel 104 coupled to an upper surface 103 of hull 102 and extending upwards towards a water surface 108 and approximately perpendicularly thereto. Coupled to keel 104 is wind-catching assembly 106, which acts as a sail or wing to propel SSV 100. SSV 100 is shown in operation, with hull assembly 102 completely submerged under a water surface 108 and keel 104 almost completely submerged as SSV 100 is propelled through water by wind acting against wind-catching assembly 106. In practice, keel 104 may alternate between being fully submerged or mostly submerged as waves, swell and wind act upon SSV 100. FIG. 1B illustrates a different perspective view of SSV 100 as it would appear being propelled underwater by wind-catching assembly 106. Note that the relative dimensions of the various parts of apparatus SSV 100 shown in FIG. 1B may not be in proportion to each other.

With hull assembly 102 being completely submerged under water surface 108, several advantages are realized over traditional, surface sailing vessels. First, because SSV is fully submerged, drag is reduced due to the elimination of wave-making drag on the water surface 108, as in traditional surface sailing vessels. Second, vessel stability is increased because SSV 100 no longer floats on water surface 108, reducing or eliminating forces that act on SSV 100 such as wind, waves, and swells. Third, restrictions on the shape of hull assembly 102 are greatly reduced, because hull assembly 102 no longer cuts through water surface 108. This allows a wider variety of hull sizes and shapes, such as the one shown in FIG. 1A. Fourth, by locating the keel 104 above hull 102, a rolling moment created by the wind as it acts upon wind-catching assembly 106 is reduced by a resisting moment created by keel 104. This is a significant advantage over traditional surface sailing vessels, as the location of the keel underneath traditional sailing hulls always acts to increase this rolling moment.

The size, shape, weight and/or displacement of hull assembly 102, keel 104 and wind-catching assembly 106 must be carefully chosen to enable SSV 100 to maintain, generally, neutral buoyancy, while also considering other factors such as side forces that act on all three components, as well as a rolling moment and restoring force.

In one embodiment, design of SSV 100 begins by defining certain hull assembly parameters, such as the intended size and shape requirements, weight, displacement requirements, equipment requirements, center of gravity, center of buoyancy, drag, etc. First, hull 102 is designed to be submersible, i.e., having an inside area protected from the water when hull 102 is completely submerged underwater during vessel travel and operation. Generally, one objective in defining the hull parameters is a hull assembly that is generally negatively buoyant after factoring in equipment, fuel, passengers, crew, food, water, etc. and is further dependent on such factors as total vehicle mass, drag, and performance requirements. More particularly, 100 hull assembly 102 is generally negatively buoyant after including the weight of wind-catching assembly 106. Hull assembly 102 may comprise one or more engines, navigation equipment, a propulsion system, a steering system, one or more buoyancy compensators, life-support systems, etc. One benefit of hull 102 being completely submerged during operation is that its shape or cross-section is not limited to typical cylindrical torpedo shapes, but can generally comprise a wide variety of other shapes, such as spherical, rectangular, or an irregular shape, as shown in FIG. 1A. This provides for an underwater body capable of being designed for specific mission objectives, such as delivery, storage, observation, and may be designed in a streamlined shape to improve performance.

Figure 1C:
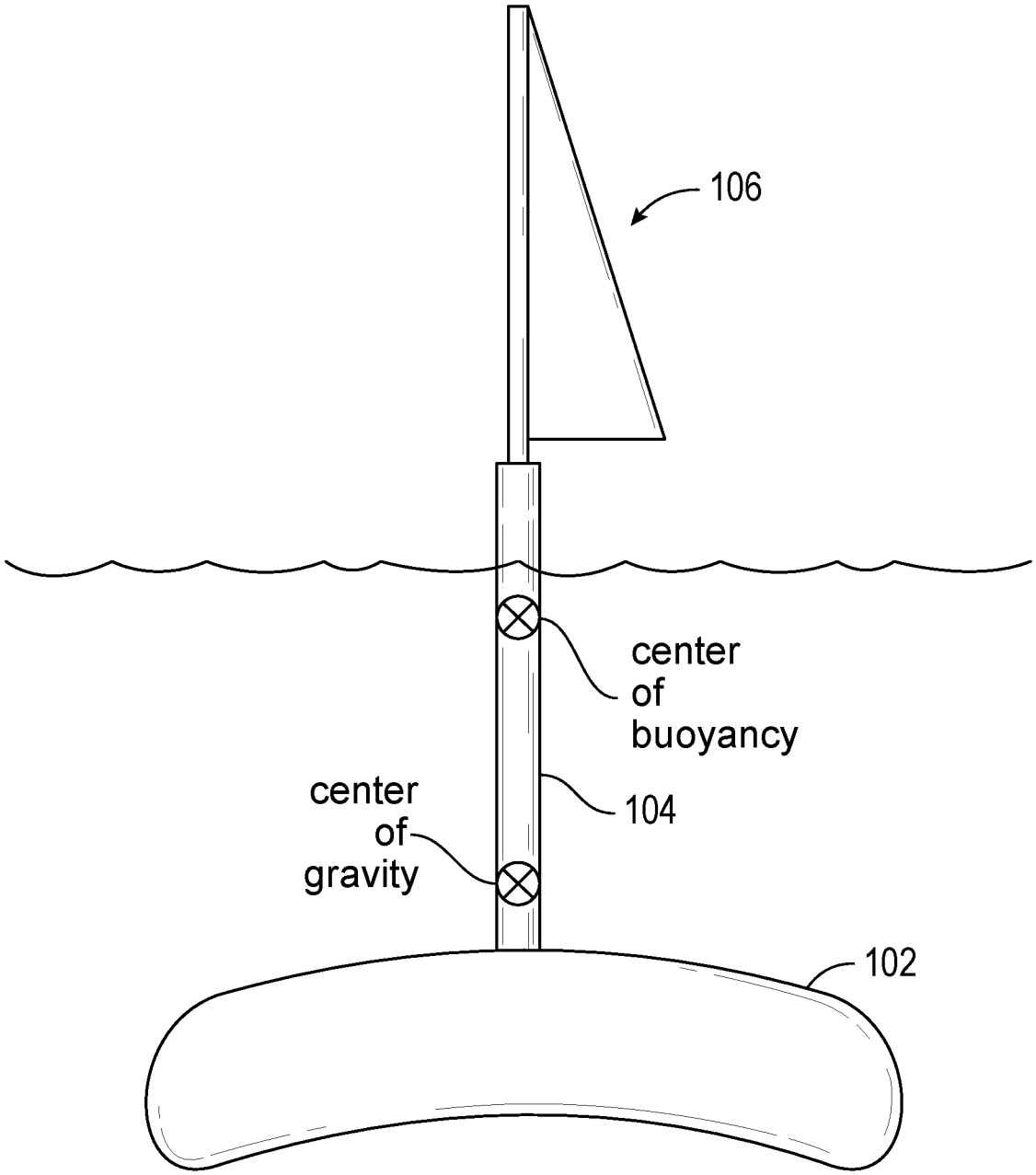
FIG. 1C is a rear, plan view of the submerged sailing vessel as shown in FIG. 1, highlighting a center of gravity and a center of buoyancy.

Once the hull assembly has been defined, the keel 104 and wind-catching assembly 106 can be defined. Keel 104 generally comprises a longitudinal, hydrodynamic in cross-section, to create lift in opposition to the side force created by the wind against wind-catching assembly 106. Aspects of the keel comprise a length (span), width, cross-section, chord, weight, and displacement. The length, width and cross-section of the keel will determine how much side force the keel will experience as SSV 100 is propelled through the water by the wind. The span (i.e., perpendicular length of the keel) largely determines a righting moment that resists a rolling moment caused by the wind as it acts upon wind-catching mechanism 106, both acting about a buoyancy, as shown in FIG. 1C. The center of gravity of SSV 100 is generally located near hull 102 as a result of most of the mass of SSV 100 resultant from hull 102, and is located below a center of buoyancy of SSV 100. The keel area, which is generally the average keel chord times the keel span, is typically sized to put a keel lift coefficient in a nominal range to combat the wing's side force which is determined by at least the area of wind-catching assembly 106, the wind speed, and the speed of SSV 100. In one embodiment, keel 104 is sized and shaped to prevent SSV 100 from tipping over into the water under the most extreme rolling moment experienced by SSV 100.

In one embodiment, keel 104 is wider near the water surface than where it is coupled to hull assembly 102. This arrangement provides for most of the volume of keel 104 as far above the center of gravity of SSV 100 as possible, thus increasing the righting moment, and provides some reserve buoyancy to combat the effects of waves.

Buoyancy is another factor in designing keel 104. In one embodiment, keel 104 is sized and shaped to have positive buoyancy, enough to offset the negative buoyancy of hull assembly 102 and the weight of wind-catching assembly 106 so that a general neutral overall buoyancy of SSV 100 is achieved. Of course, material selection affects the buoyancy of keel 104, so that must be figured into the design as well. In some embodiments, buoyancy is less of a factor when hull assembly 102 comprises a buoyancy compensation system, as will be explained in greater detail below.

The keel is typically constructed of a strong, stiff material such as wood, metal, or one of a variety of composite materials. In one embodiment, the keel may be at least partially hollow to increase its buoyancy. In another embodiment, the keel is inflatable, made from a flexible material such as rubber, synthetic rubber or similar compounds that are durable yet inflatable. In this embodiment, hull assembly typically houses one or more pumps, motors, or storage tanks coupled to an inlet port of keel 104 in order to inflate and/or deflate keel 104. In yet another embodiment, the keel is hollow throughout the length of the keel and large enough to allow one or more conduits to pass, such as in embodiments where electrical or plumbing conduits are desired. In yet still another embodiment, the keel is sized and shaped to allow the ingress and egress of one or more passengers and/or vessel operators from the water's surface into hull assembly 102.

The length and width of keel 104, (i.e., a side surface area), has an effect on the righting moment; the greater the side surface area of keel 104 the greater the righting moment applied to SSV 100 when wind blows over/against wind-catching assembly 106. The length and width of keel 104 is calculated to account for this righting moment, which is affected by the area of wind-catching assembly 106 and the rolling moment that it creates, as well as the mass and area of hull assembly 102, which also acts to counter-act the rolling moment. It is often advantageous for keel 104 to be wider near the water surface than near hull assembly 102, because by doing so, a greater righting moment is created. Additionally, the thickness of keel 104 may be tapered along its length, becoming thicker at the top and more narrow near the bottom, near hull assembly 102, which also serves to counter the rolling moment.

Keel 104 may be coupled to hull assembly using well-known techniques such as welding, bolting, riveting, adhesive bonding, etc. In another embodiment, keel 104 is pivotally coupled to hull assembly 102 that may allow hull assembly 102 either pitch fore and aft, from side-to-side, or both, potentially reducing the effects of wind, waves, and swells on SSV 100 or, more particularly, hull assembly 102.

Typically, wind-catching assembly 106 comprises at least one mast, at least one sail or "wing" and other components, such as a boom, rigging, etc. typically found on most traditional sailboats. The sail is configured to generate a force vector in response to wind blowing across and/or against the sail. The mast extends upward from the keel and the sail's "foot" or lower edge is ideally very close to the water surface, in some embodiments, a matter of inches. However, in practice the foot may be located a foot or more above the water surface, in an attempt to keep the sail from becoming wet due to the varying nature of the water surface as wind, waves and swells act on SSV 100.

In one embodiment, the sail is rigid and constructed from a lightweight, substantially rigid material such as molded fiber composite material or aluminum alloy. In cross-section, the sail (sometimes referred to as a "wing" or "wingsail") is preferably configured as an airfoil that generates propulsive force (analogous to upward "lift" of an aircraft wing, but in a generally horizontal direction) regardless of whether the angle of attack is to the right or left of the wind, suitable foil configurations being known to those skilled in the relevant art. In another embodiment, the sail is constructed from a lightweight, flexible material such as cloth, nylon, Dacron®, Spectra®, Dyneema®, mylar, carbon fiber, etc. In these embodiments, wind-catching assembly 106 may be partially or fully inflated by the flow and pressure of incident wind, i.e., when wind-catching assembly 106 is formed similar to a ram air hang glider or kite wing.

The mast may be hollow or solid and constructed from a substantially rigid material such as wood, fiber composites, fiberglass, etc. In one embodiment, the mast is constructed telescopically in sections, allowing the mast to be extended and retracted, typically by a combination of one or more actuators, motors, gears, pulleys, gas or water pressure, etc. In another embodiment, a retractable/extendable mast may be made from a flexible, inflatable material that, when erected, forms a substantially rigid spar capable of supporting one or more sails.

Design considerations of wind-catching assembly 106 comprise size, weight, power production, rolling moment, and side force in a variety of wind conditions, cost, and, in some embodiments, extendibility/retractability.

After the hull assembly, keel and wind-catching assembly have been defined, a total weight, total displacement and righting moment of SSV may be determined, using calculations well known in the art. As mentioned previously, a righting moment is created by virtue of the fact that there is a center of gravity of SSV 100 located well-below the water surface, and a center of buoyancy near the water surface. When SSV 100 rolls due to wind acting on wind-catching assembly 106, the center of gravity of SSV 100 gets displaced laterally from the center of buoyancy, and there is a restoring, righting moment created to counter-act the rolling moment. In addition, the rolling moment is reduced or eliminated because keel 104 is located above the hull assembly, i.e., above a center of gravity of SSV 100, and thus the side force produced by keel 104 to counteract the side force produced by the wind against wind-catching assembly 106 also acts to reduce or eliminate the rolling moment. This is a major advantage over traditional, surface sailing vessels, where the keel always adds to the rolling moment.

If these calculations, above, indicate that a change is needed in one or more of the hull assembly, keel or wind catching assembly, one or more of these components may be re-designed, and the total weight, displacement and righting moment re-calculated in an iterative process until these calculations are acceptable.

Next, a number of hydrostatic and flotation calculations are performed, as well-known in the art, to ensure that SSV 100 meets all of the design requirements, and that it will in fact float with hull assembly 102 completely submerged, keel 104 completely/mostly submerged and wind-catching assembly positioned above the surface of the water.

Next, one or more performance metrics may be calculated, for example, calculations to predict aerodynamic and hydrodynamic performance in actual use, equilibrium, etc. If the performance results are not acceptable to the designer, the hull assembly, keel and/or wind-catching assembly design specifications may be altered in an effort to achieve desired results.

Figure 1D:
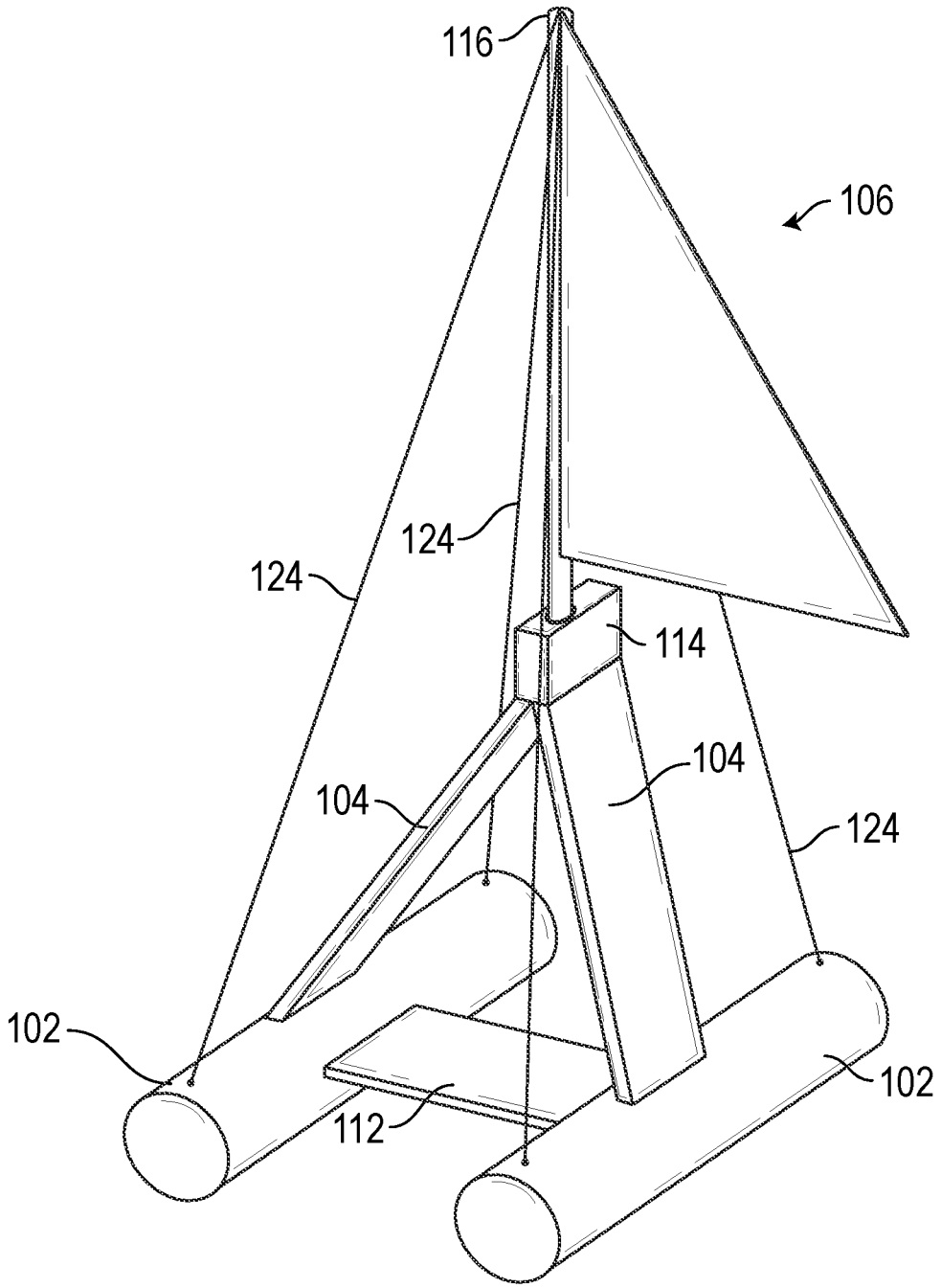
FIG. 1D is another embodiment of a submerged sailing vessel comprising two hulls.

FIG. 1D is another embodiment of a submerged sailing vessel (SSV) 110, comprising a dual-hull, "A" frame design. Note that the relative dimensions of the various parts of apparatus 1200 may not be in proportion to each other as shown in FIG. 1D. In this embodiment, two hulls 102 are shaped as cylindrical bodies, coupled to one another via strut 112, which forms a fixed relationship between the two hulls. The hulls are further coupled together via two keels 104, forming an "A" frame structure with the hulls and strut 112. This design provides a great deal of strength and stability to SSV 110, while retaining the benefits of the design shown in FIGS. 1A-1C, notably an under-water vessel propelled by the wind via wind-catching assembly 106. In another embodiment, the two hulls may be replaced by a single hull having its width much larger than its height, for example, similar in shape to a manta ray, and the keels attached to a top side of this single hull at locations separated from one another to form the "A" structure. As in the previously-described embodiment, the keels provide a resistive side force and righting moment to a side force and rolling moment caused by the wind as it acts upon wind-catching assembly 106. Moreover, many of the attributes of the previously-described embodiment is found in this embodiment, such as the center of gravity of SSV 110 being near the hulls and below a center of buoyancy, keels that are narrow at the point of contact with the hulls and gradually increasing in width along a length of the keels upwards towards wind-catching assembly 106, wind-catching assembly 106, etc. Wind-catching assembly 106 may be coupled directly to a meeting point 114 of the two keels, or it may be coupled via an intermediary structure (not shown) so that mast 116 of wind-catching assembly 106 can be located either fore or aft of the keels.

Figure 1E:
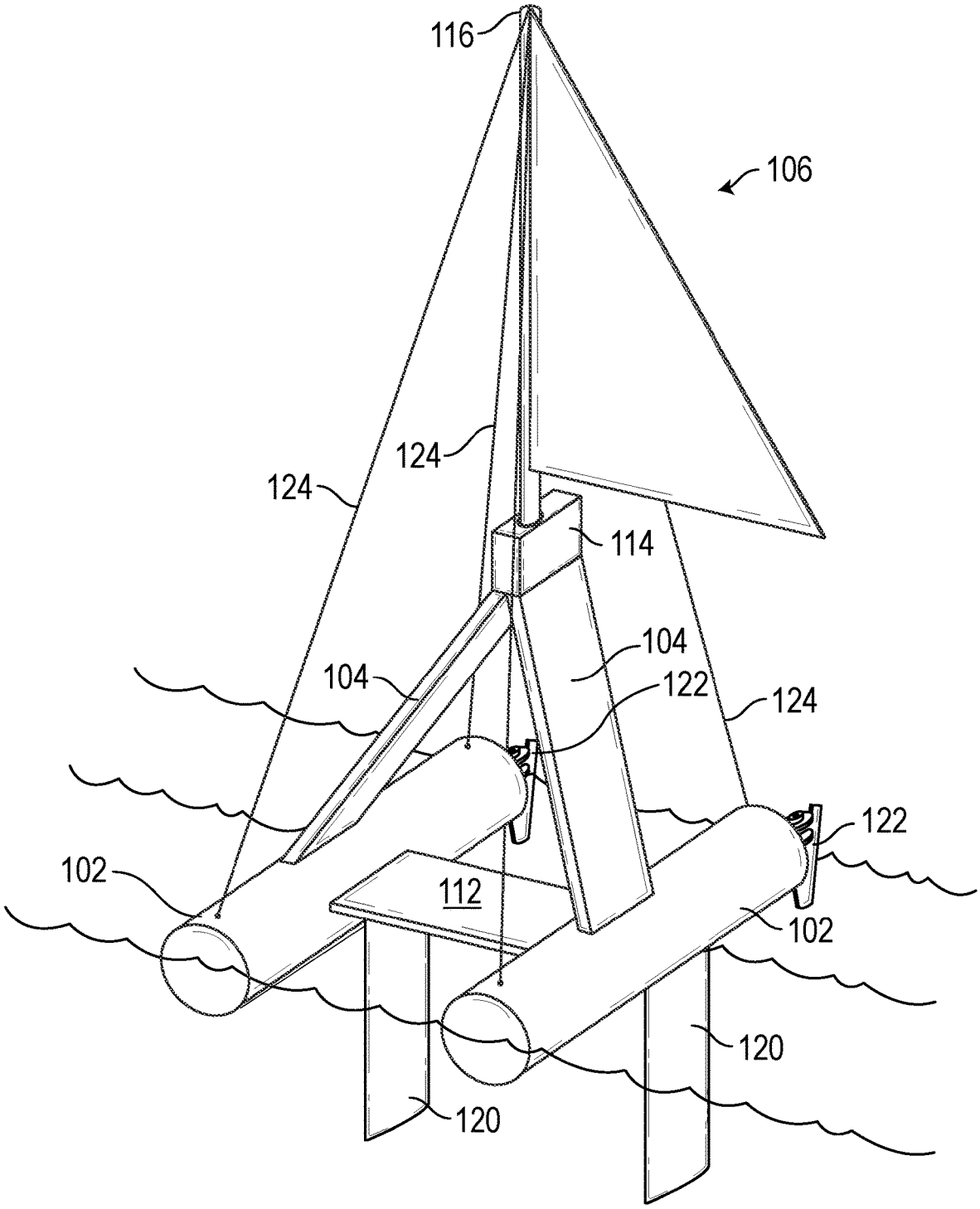
FIG. 1E is yet another embodiment of a submerged sailing vessel capable of both under water and surface operation.

The arrangement of the components of SSV 110 is especially useful when loading and unloading SSV 110. Generally, during loading and unloading, SSV 110 is raised upwards until the hulls 102 float on the water surface, as shown in FIG. 1E. In this position, SSV 110 is buoyant and floating on top of the water, allowing access to the keels and the hulls, and the stability may be increased further by manufacturing SSV 110 with the hulls further apart from one another that what is shown in FIGS. 1D and 1E. Cargo and fuel may then be loaded or unloaded into each of the hulls. When SSV 110 has surfaced, both keels 104 extend upward into the air from upper surface 103 of the hulls, and wind-catching assembly 106 is thrust further upwards, which greatly increases a rolling moment experienced by SSV 110 when wind or waves act upon SSV 110. As such, it may be especially desirable, in this configuration, to stow, retract, remove or otherwise disengage wind-catching assembly 106 and/or keel 104 to avoid this undesirable condition. This may be accomplished by dropping a sail of wind-catching assembly 106, deflating a wing of wind-catching assembly, folding wind-catching assembly over into the water or into a holding bin coupled to SSV 110, etc. In another embodiment, guy wires 124 may be implemented to stabilize wind-catching assembly 106.

After loading or unloading, SSV 110 may be lowered below the water surface, again using buoyancy-compensation techniques, until just wind-catching assembly 106 is protruding from the water surface.

FIG. 1E is yet another embodiment of a submersible sailing vessel 118, combining elements of the embodiments described in FIGS. 1A-1E. In this embodiment SSV 118 is designed to operate both under-water and on the water's surface. As before, SSV 118 comprises one or more hulls 102 joined by one or more struts 112 and keels 104, with wind-catching assembly 106 for propelling SSV 118 under water and, additionally, comprises keels 120 and rudders 122 for operation of SSV 118 on the water's surface. SSV 118 further comprises one or more well-known buoyancy-compensation systems (not shown) to position the hulls either under water or on the water surface. While under-water, wind-catching assembly 106 operates as before, propelling the hulls underwater, while keels 104 provide the necessary, opposing side forces and restoring moments to counter the side force and rolling moment from wind-catching assembly 106. When positioned on the water surface, wind-catching assembly 106 may be used to again propel SSV 118 on the water surface, and/or SSV 118 may be equipped with a traditional, surface propulsion system, such as a motor and propeller (not shown) to replace or augment propulsion from wind-catching assembly 106. Keels 120 provide traditional side and rotational forces to counter the side and rolling forces from wind-catching assembly 106, while rudders 122 are used to steer.

Figure 2:
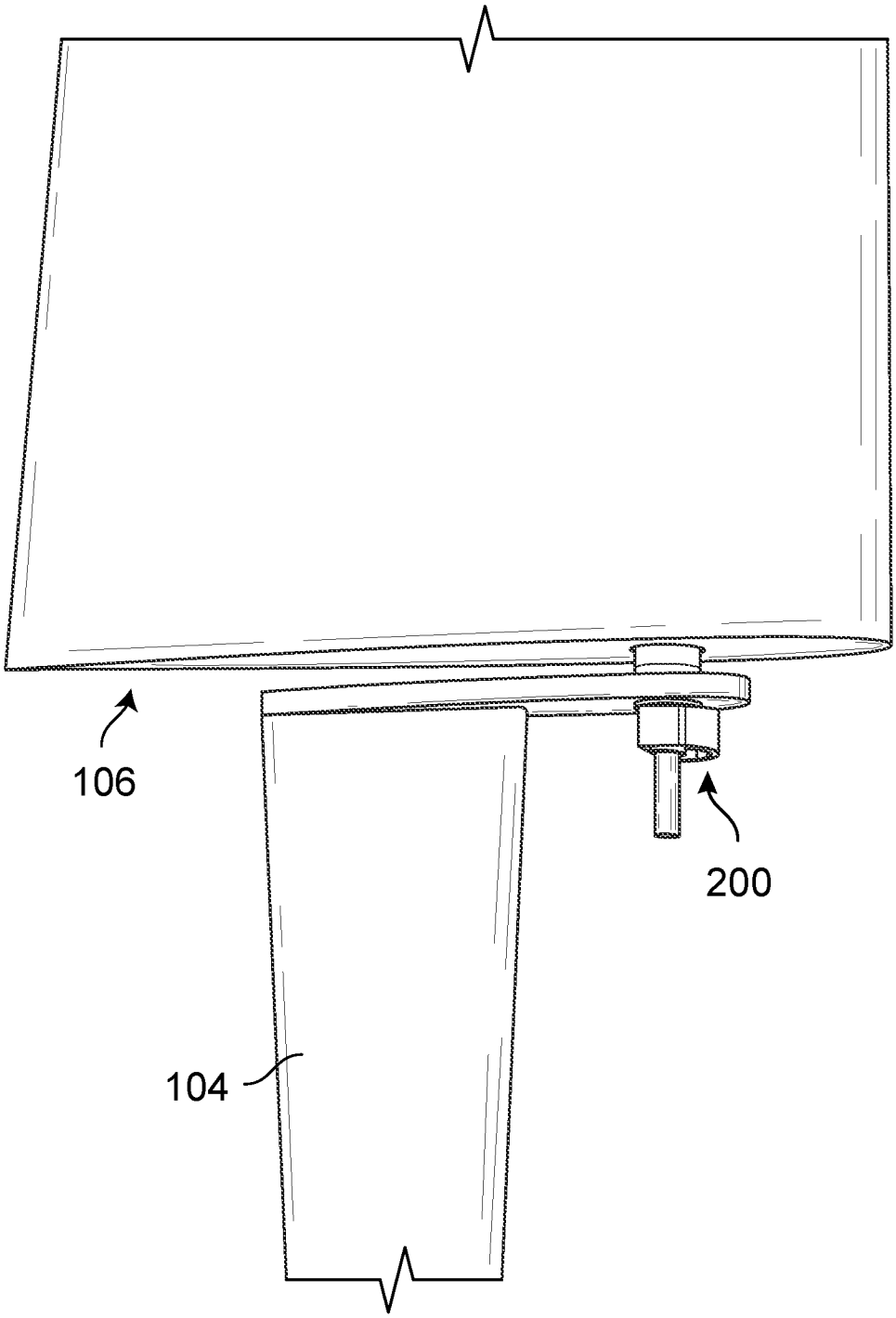
FIG. 2 is an illustration of a passive, automatic wing control mechanism used to position a wind-catching assembly of the submerged sailing vessel of FIG. 1 in an optimal angle with respect to an apparent wind experienced by the wind-catching assembly.

In one embodiment, wind-catching assembly 106 is coupled to keel 104 via a passive, automatic wing control mechanism 200, as shown in FIG. 2. This is a significant improvement over the prior art in that it enables automatic, unpowered sail or wing control in an autonomous sailing vessel or even on surface sailing vessels. In order for any sail or wing to effectively capture and utilize the wind, depending on the desired course of the vessel, there may be a need to adjust the wing's orientation with respect to the apparent wind to optimize its efficiency. Traditionally, this is done in sailing vessels manually by crew members pulling on ropes or operating winches, motors or hydraulic actuators, and in the case of autonomous vessels, with motors or actuators. Automatic wing control mechanism 200 is configured to set the wing nearly optimally using passive means, without controllers, actuators, or power. This is accomplished through the use of a novel arrangement of pivots, lost motion, constant torque springs, and dampers, as shown in more detail in FIG. 3.

Figure 3:
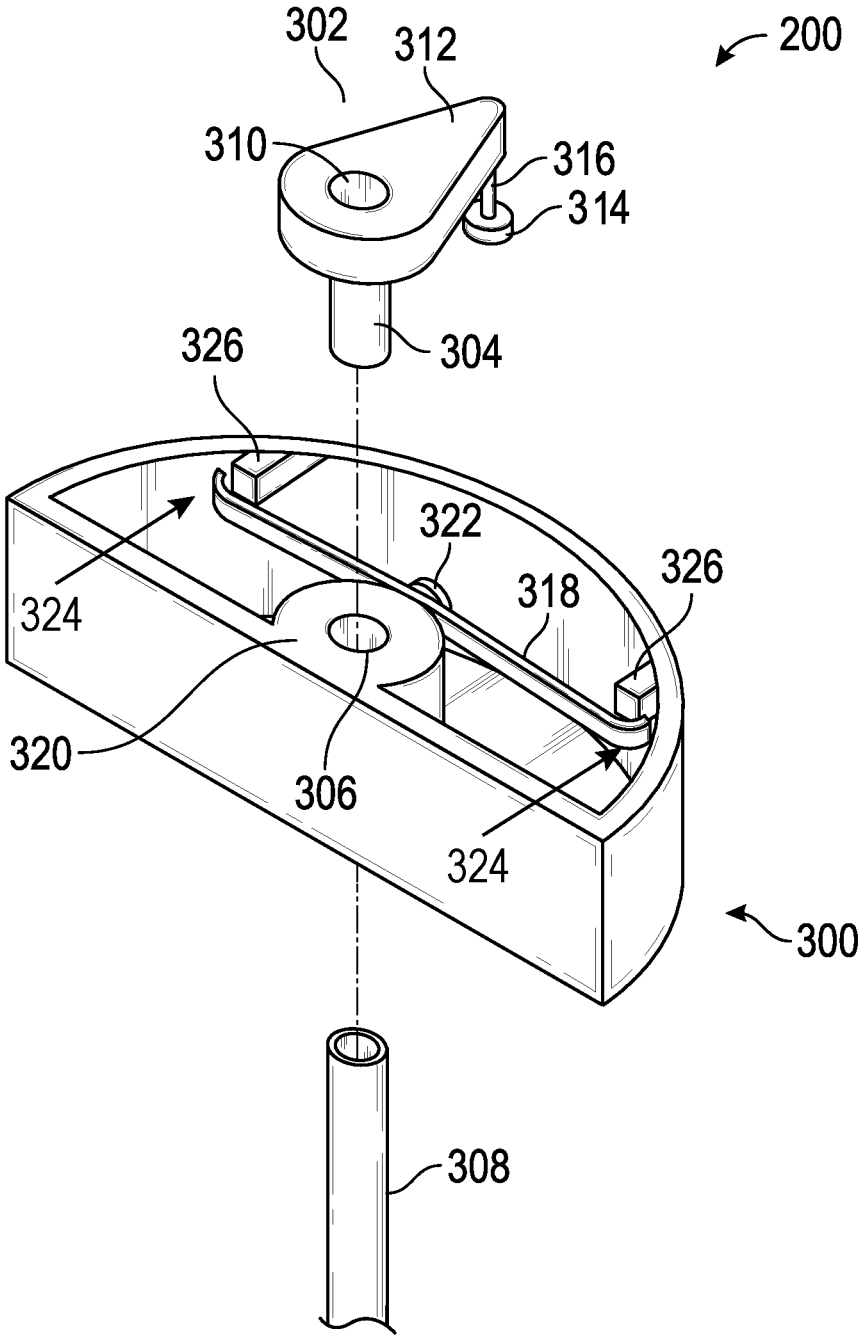
FIG. 3 illustrates an exploded view of the passive, automatic wing control mechanism shown in FIG. 2.

FIG. 3 illustrates an exploded, bottom, perspective view of the automatic wing control mechanism 200. Automatic wing control mechanism 200 comprises housing assembly 300 and pivot assembly 302. In operation, pivot assembly 302 is installed onto housing assembly 300 by placing hollow tube extension 304 into through-hole 306, formed through drum 320. In one embodiment, mast 308 of wind-catching assembly 106 is placed through through-hole 306 and into, and secured to, hollow tube extension 304. In another embodiment, tube extension 304 is not used, and mast 308 is mounted through through-hole 306 and into pivot assembly 302 via hole 310, which may extend entirely through the height of arm 312 of pivot assembly 302, as shown, or merely part-way. In either case, mast 308 is secured to pivot assembly 302 and is not rotatable with respect to pivot assembly 302. This arrangement allows mast 308 to rotate with respect to hull 102.

Once installed, pivot assembly 302 is rotatable about an axis through the center of through-hole 306, while roller 314 engages tension bar 318, as will be described in more detail below. Extension 316 may be needed in order to position roller 314 in contact with tension bar 318 in some embodiments. However, in other embodiment, roller 314 may be coupled directly to arm 312 or be incorporated as a protrusion of arm 312. In one embodiment, roller 314 comprises a contoured surface, such a cylinder or sphere, to lower a coefficient of friction between roller 314 and tension bar 318. In another embodiment, roller 314 is rotatable about a longitudinal axis of extension 316, or rotatable with respect to arm 312 in embodiments where extension 316 is not used. This, again, reduces friction between roller 314 and tension bar 318.

Tension bar 318 comprises a relatively thin section of stiff yet flexible material, such as one or more strips of metal, bendable plastic, or some other material having a bending stiffness. Tension bar 318 acts to supply a restoring force against roller 314 as roller 314 rotates about hole 306, caused by wind blowing across wind-catching assembly 106. Bending stiffness is the resistance of a member against bending deformation, and is a function of elastic modulus, an area moment of inertia of the tension bar cross-section about an axis of interest, length of the tension bar, and boundary condition. The thickness and material selection of tension bar 318 determines the bending stiffness of tension bar 318 and, thus, a magnitude of a restoring force against roller 314 as roller 314 attempts to travel along tension bar 318. In one embodiment, the rotational moment caused by tension bar 318 is relatively constant, no matter the position of roller 314 about hole 306. The bending of tension bar 318 around drum 320 describes a radius where tension bar 318 is wrapped around the drum, but the free end remains tangent to the drum. This tangent "tail" applies a restoring force to roller 314, and thus transmitted to the wing, acting to restore the wing to an optimum apparent wind angle.

Tension bar 318 may be replaced, in other embodiments, with some other mechanism that exerts a restoring force against arm 312. For example, a spiral torsion spring could be used to provide the restoring force, two coil springs could be used, two gas-filled struts, or some other mechanism(s) known in the art for providing a restoring force against arm 312.

Tension bar 318 may experience side forces as roller 314 rotates around hold 306. To combat these forces, tension bar 318 is typically held in place by a fastener 322, such as a screw, bolt, rivet, etc. as shown, and/or by curling ends 324 of tension bar 318 and utilizing stops 326 to cause each end 324 to "hook" a respective stop 326 when roller 314 is rotated about hole 306.

Figure 4:
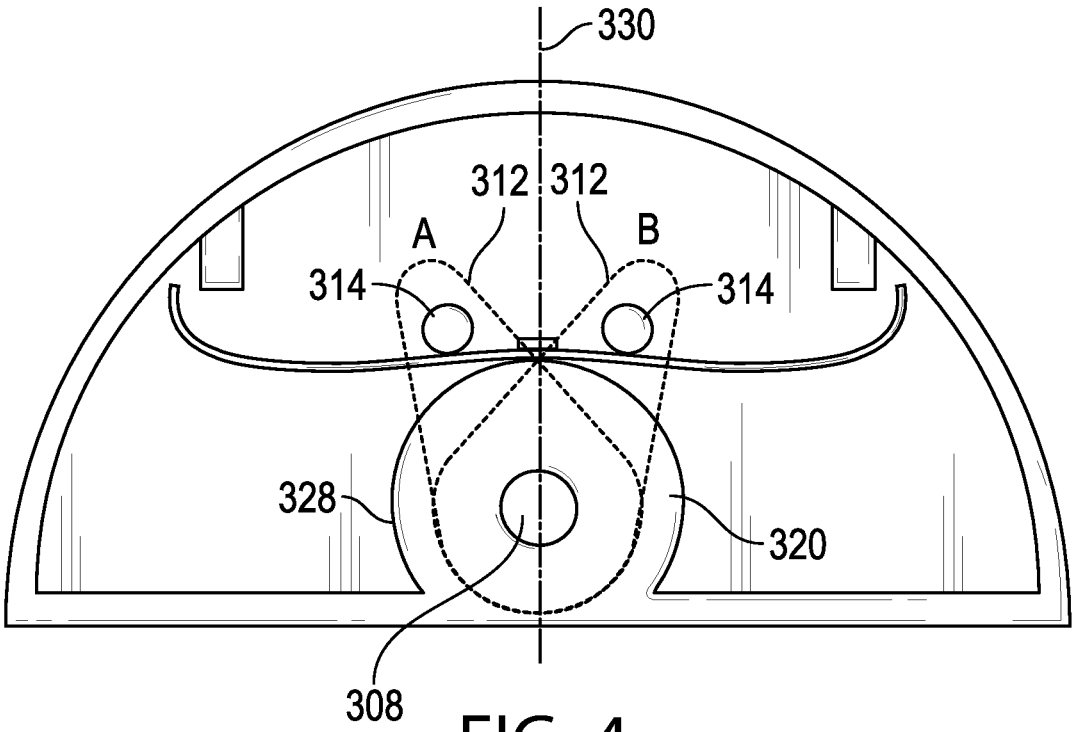
FIG. 4 is a bottom, plan view of one embodiment of the passive, automatic wing control mechanism of FIG. 2.
Figure 5A:
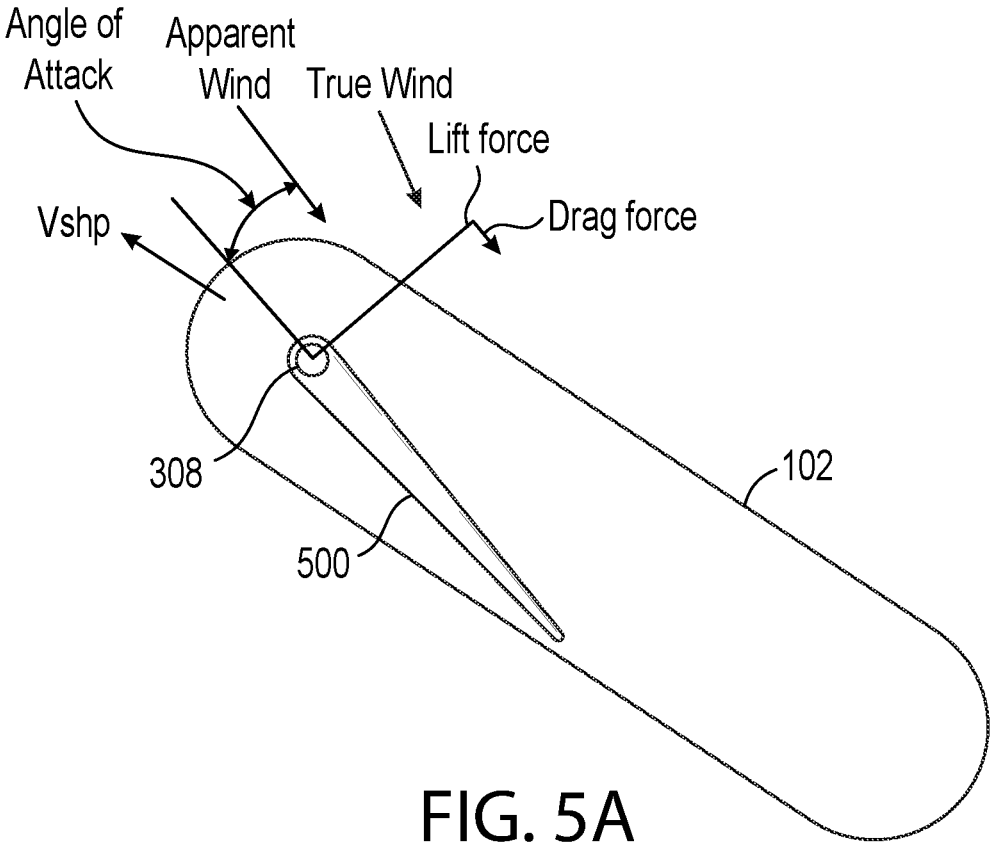
FIGS. 5A and 5B are top, plan views of the submerged sailing vessel as shown in FIG. 1 as the submerged sailing vessel sails into the wind coming from a starboard side and a port side, respectively.
Figure 5B:
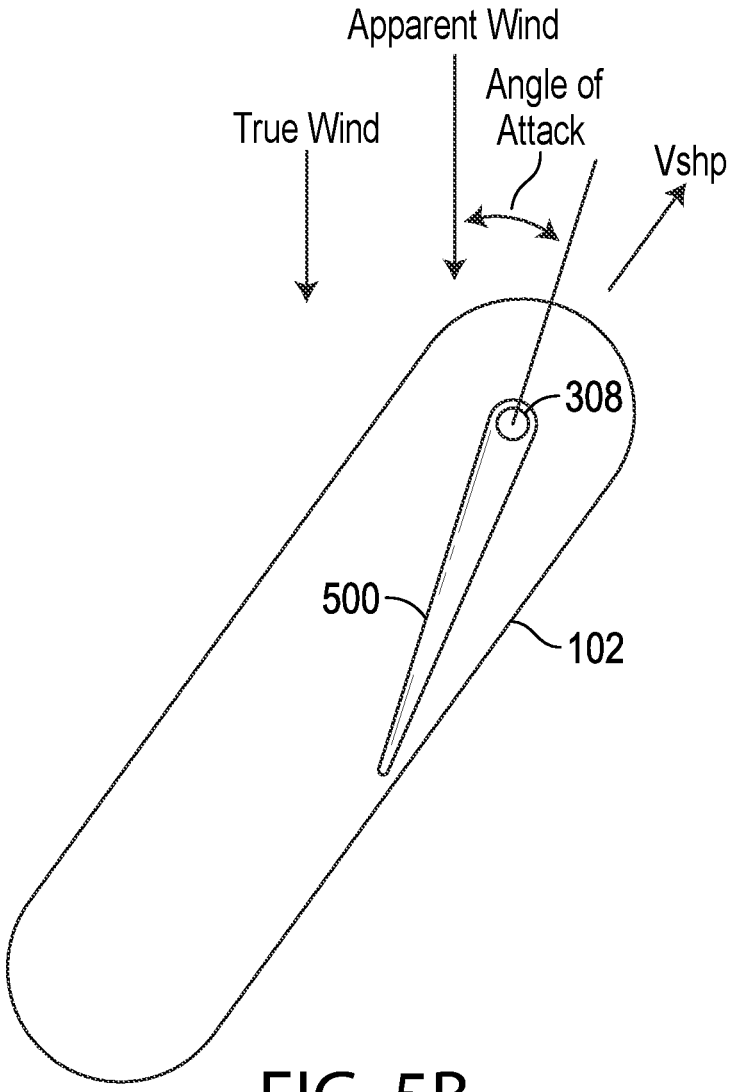

FIG. 4 is a bottom, plan view of automatic wing control mechanism 200, with pivot assembly arm 312 shown in dashed lines to better illustrate the interaction between roller 314 and tension bar 318. Mast 308 has been inserted through through-hole 306 and secured within hole 310 of arm 312. Mast 308 may be flush with a surface of arm 312 or protrude therefrom. FIG. 4 illustrates pivot assembly 302 positioned at two different times, in an "A" position and a "B" position, corresponding to an angle of wing 500 with respect to hull 102 as shown in FIGS. 5*a* and 5*b*, respectively. When wing 500 is in alignment with a centerline of SSV 100 extending through the mid-point of both the bow and the stern, pivot assembly 302 rests at a mid-point of a centerline of drum 320, i.e., mid-way between positions A and B. It should be understood that although drum 320 is shown in FIG. 4 as having a surface 328 formed into a half-circle shape, in other embodiments, surface 328 can be contoured to help achieve a desired force against roller 314, i.e., it may comprise a cam shape, where the slope at any point on surface 328 increases (or decreases) moving away from a centerline 330 of drum 320.

FIGS. 5A and 5B each illustrate a top, plan view of SSV 100, with hull 102 submerged below a water surface, showing the position of wing 500 with respect to hull 102. In FIG. 5A, the true wind is coming from the starboard bow and wing 500 is pushed by the wind into the position shown, creating lift which propels SSV 100 into the wind. This position is referred to as "close-hauled," where wing 500 is held tightly to the centerline of hull 102, and the course of SSV is as close to the apparent wind as it can sail efficiently. In this arrangement, a center of pressure on wing 500 approximately coincides with a pivot location (i.e., mast 308) and thus is in equilibrium with an angle of attack at an optimum angle of about 20 degrees.

The lift rotates wing 500 clockwise about mast 308 until roller 314 comes in contact with tension bar 318, as shown in FIG. 4, position "A". Wing 500 is prevented from achieving a greater angle from the centerline by the force exerted against roller 314 by tension bar 318 as the bending stiffness of tension bar 318 acts against roller 314 with a restoring force back to the position shown in position "A" in FIG. 4, causing the wing 500 to maintain a predetermined angle with respect to the apparent wind. Typically, roller 314 will travel just slightly around drum 320, as the center of pressure may not be exactly aligned with mast 308, causing a small moment about mast 308. Tension bar 318 is constructed of materials and/or dimensions to achieve a bending stiffness sufficient to keep wing 500 at an optimal angle to the apparent wind, no matter what angle SSV 100 is traveling.

Similarly, when the apparent wind is coming from the port bow, as shown in FIG. 5B, wing 500 is pushed by the wind into the position shown, creating lift which propels SSV 100 into the wind. A center of pressure on wing 500 approximately coincides with a pivot location (i.e., mast 308) and thus is in equilibrium with an angle of attack at an optimum angle of about 20 degrees. The lift rotates wing 500 counter-clockwise about mast 308 until roller 314 comes in contact with tension bar 318, as shown in FIG. 4, position "B". As before, wing 500 is prevented from achieving a greater angle from the centerline by the force exerted against roller 314 by tension bar 318 as the bending stiffness of tension bar 318 acts to return roller 314 to the position shown in position "B" in FIG. 4.

Wing 500 may rotate between the positions shown in FIGS. 5A and 5B when, for example, SSV 100 is headed directly into the wind. SSV 100 will generally not maintain this heading for long, as SSV 100 will tend to rotate either to the starboard or the port, until wing 500 catches the wind when SSV 100 is at an angle of 22 degrees or so to the apparent wind. Wing 500 may flop erratically back and forth between the angles shown in FIGS. 5A and 5B, causing pivot assembly to rotate back and forth, between positions "A" and "B" in FIG. 4.

Figure 6A:
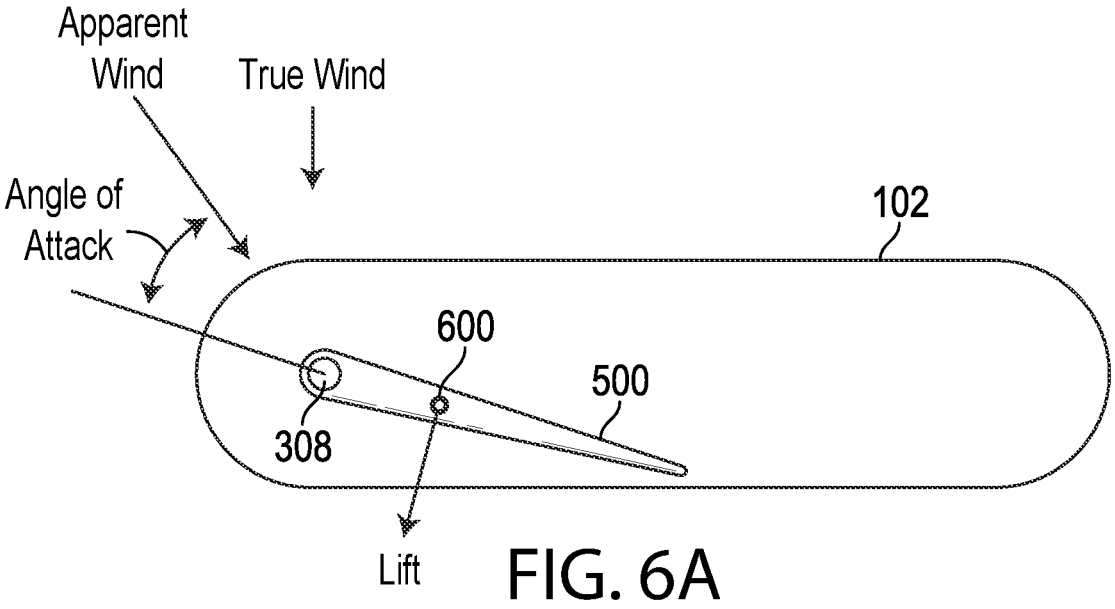
FIG. 6A is a top, plan view of the submerged sailing vessel as shown in FIG. 1 as a wing of the submerged sailing vessel stalls.

FIG. 6A is a top, plan view of SSV 100, with hull 102 submerged below a water surface, showing a "stalling" condition of wing 500 as SSV 100 is steered from the position shown in FIG. 5A to the position shown in FIG. 6A. In this heading, if wing 500 remains in the same position as in FIG. 5A, the angle of attack becomes greater than about 20 degrees, as shown, causing the wing to stall, and a center of pressure 600 (and the center of lift) moving aft of the pivot point location (i.e., mast 308). This produces a moment that acts upon wing 500 around mast 308.

Figure 6B:
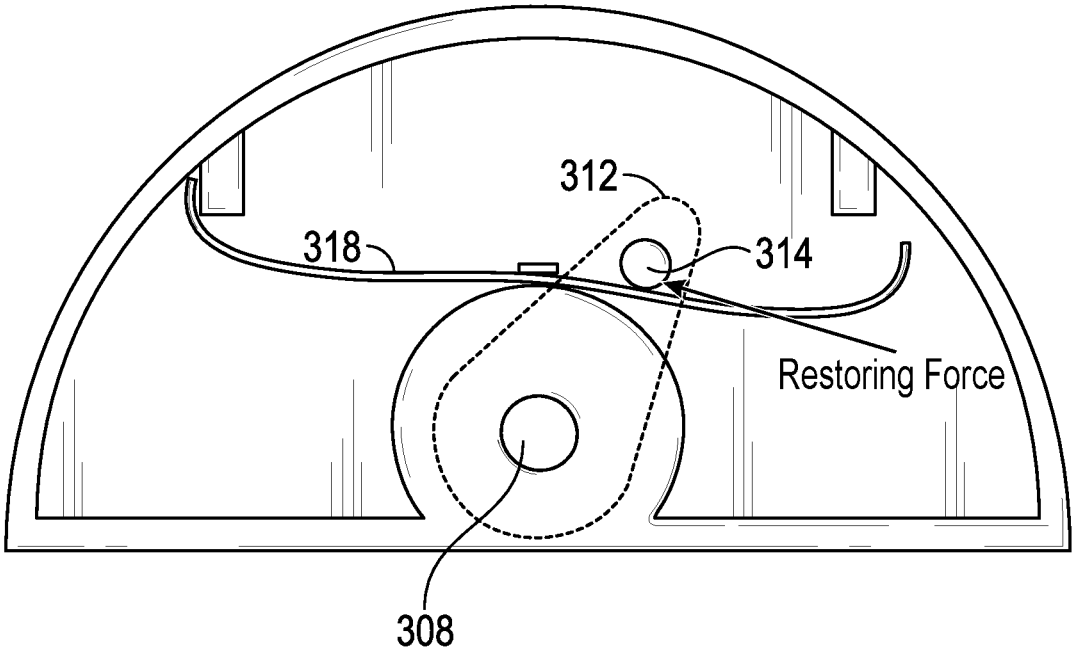
FIG. 6B is a bottom, plan view of the passive, automatic wing control mechanism of FIG. 2 when the wing shown in FIG. 6A is in a stalled position.
Figure 6C:
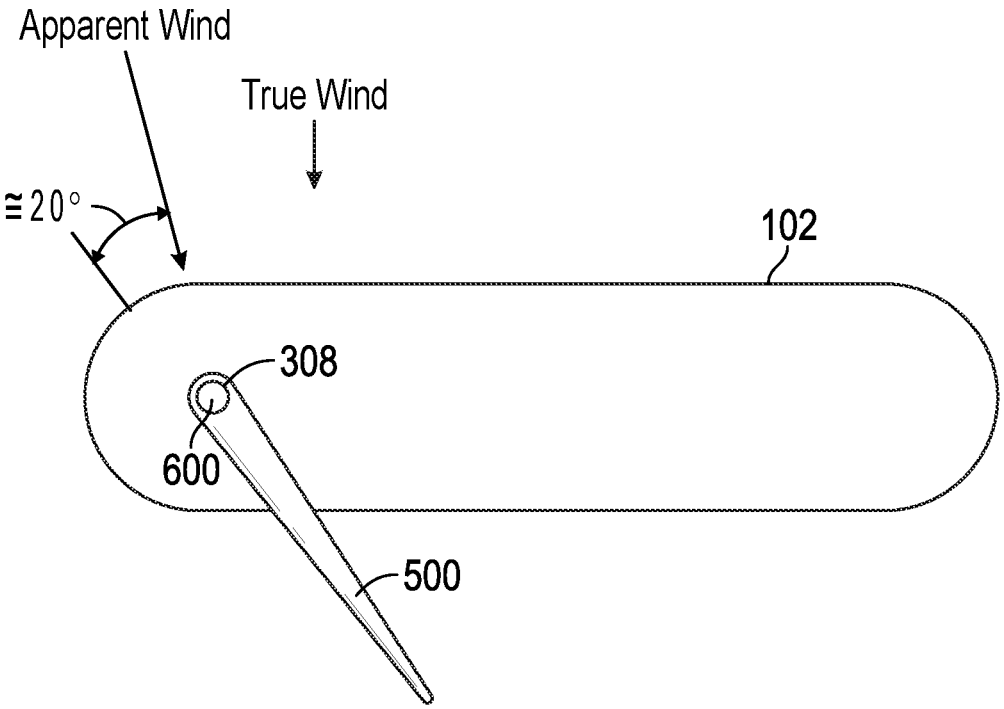
FIG. 6C is a top, plan view of the submerged sailing vessel as shown in FIG. 1 as a wing of the submerged sailing vessel achieves equilibrium as a result of being positioned by the passive, automatic wing control mechanism.

The moment causes wing 500 to rotate about mast 308. Without automatic wing control mechanism 200, wing 500 would rotate until it is in direct alignment with the apparent wind. However, as wing 500 rotates around mast 308, roller 314 travels along tension bar 318, as shown in FIG. 6B, and tension bar 318 acts upon roller 314 with a restoring force. The restoring force against roller 314 causes roller 314 stop at some point along tension bar 318, as shown in FIG. 6B, which is a point at which wing 500 is again positioned at an angle of attack of about 20 degrees to the apparent wind (see FIG. 6C). Put another way, initially the moment on the wing 500 is greater than restoring force provided by tension bar 318 against roller 314, until wing 500 rotates to the point of attached flow, whereupon moment experienced by wing 500 drops to the point where it equals the restoring force of tension bar 318 against roller 314. In this position, the center of pressure/lift 600 against wing 500 has move forward to about the pivot point (i.e., mast 308), where equilibrium is again reached and the wing is optimally set. In this position, the moment created by the wind against wing 500 is equal to the restoring force of tension bar 318 against roller 314. No matter what the heading of SSV 100, when sailing into the wind, automatic wing control mechanism 200 is designed to hold wing 500 at an optimal angle to the apparent wind, about 20 degrees. Again, tension bar 318 is designed with a predetermined stiffness in order to achieve this effect.

Figure 7:
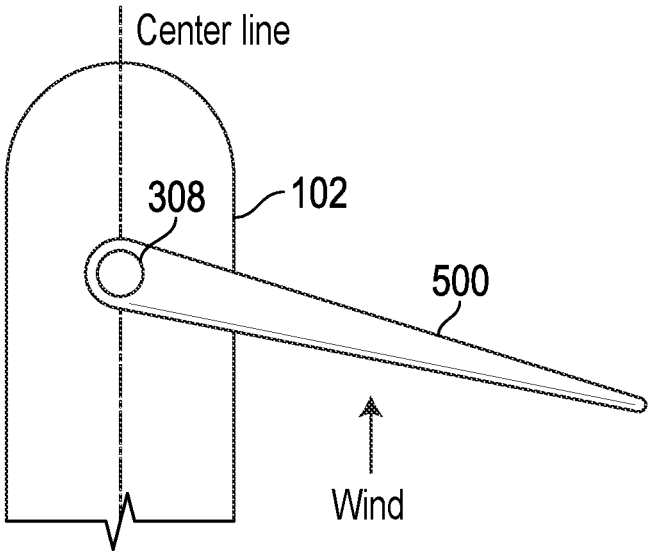
FIG. 7 is a top, plan view of the submerged sailing vessel as shown in FIG. 1 as the submerged sailing vessel sails with the wind.
Figure 8:
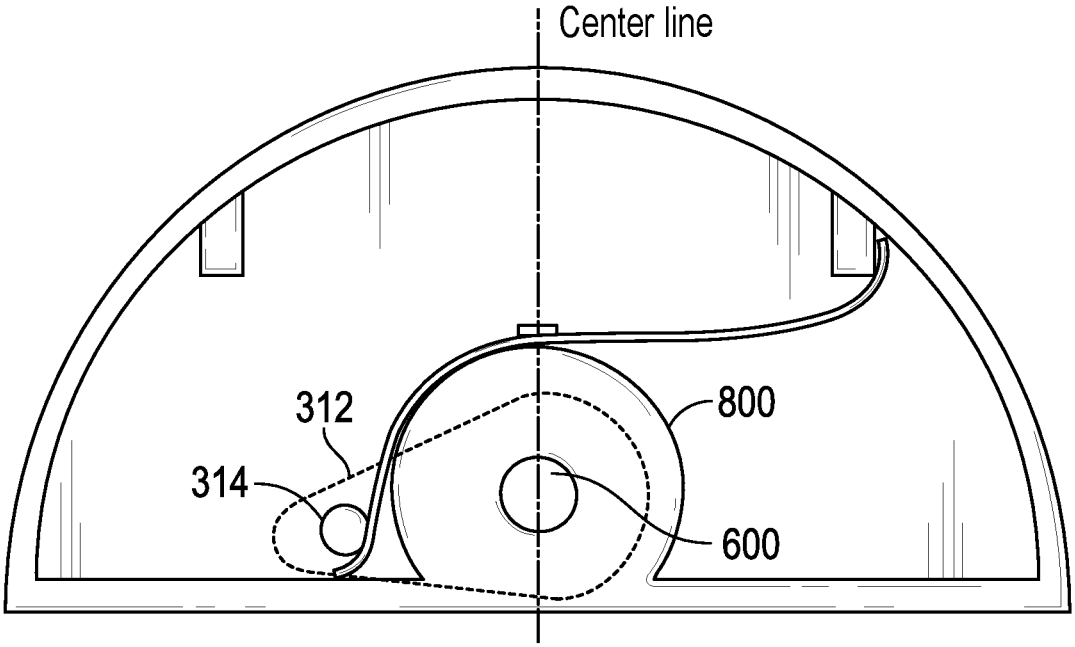
FIG. 8 is a bottom, plan view of the passive, automatic wing control mechanism of FIG. 2, shown in a position associated with sailing with the wind as shown in FIG. 7.

FIG. 7 is a top, plan view of SSV 100, again with hull 102 submerged below a water surface, showing the position of wing 500 with respect to hull 102 when sailing SSV 100 with the wind, while FIG. 8 is a bottom, plan view of automatic wing control mechanism 200 when wing 500 is in the position shown in FIG. 7. Pivot assembly 302 is shown in dashed lines, again to highlight the interaction between roller 314 and tension bar 318, rotated a maximum angle, a little less than 90 degrees from a centerline, as shown. When sailing with the wind, the wind exerts a rotational moment on wing 500 far greater than the rotational moment on wing 500 when SSV 100 is sailing into the wind. This rotational moment causes pivot assembly 302 to rotate along or just over perimeter 800 of drum 320, against tension bar 318, to the position shown in FIG. 8. The rotational moment on wing 500 is enough to overcome the restoring force of tension bar 318 against roller 314, thus allowing wing 500 to be positioned as shown in FIG. 7.

Figure 9:
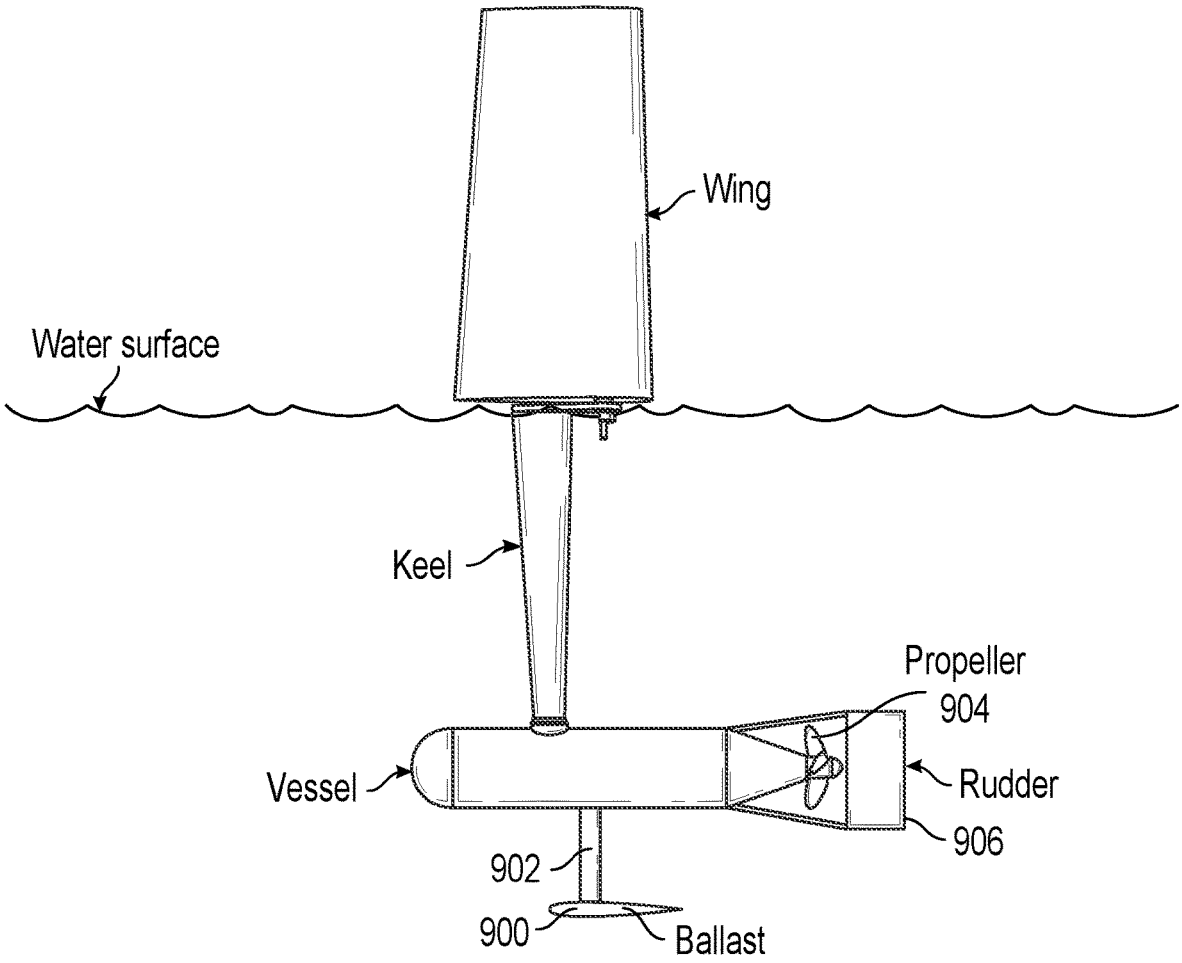
FIG. 9 illustrates one embodiment of the submerged sailing vessel of FIG. 1 having a ballast coupled to a hull assembly via a strut, as well as a propulsion assembly and rudder.

In some embodiments, SSV 100 may comprise additional components and/or capabilities. For example, FIG. 9 illustrates one embodiment of SSV 100 having a ballast 900 coupled to hull assembly 102 via a strut 902, as well as a propulsion assembly 904 and rudder 906. SSV 100 in this embodiment may comprise the ballast/strut combination only, the rudder/propeller combination only, or a combination of the two. In one embodiment, strut 902 is configured as a variable-length strut to enable real-time positioning of ballast 900 in order to, for example, adjust to rough sea or weather conditions, experience a gain or loss of mass from hull assembly 102 (for example, as people, supplies, equipment, etc. are loaded/unloaded), or when approaching shallow water limitations. Strut 902 could be constructed of a telescoping or inflatable assembly controllable by an electrical motor, pneumatics, manually, or by other means known in the art to extend and retract strut 902. In addition, strut 902 could be pivotally coupled to hull assembly 102 to allow for side-to-side positioning of ballast 900. Again, this may be accomplished either manually, automatically or semi-automatically using one or more motors, gears, pulleys, pneumatics, etc.

Ballast 900 acts as mass to increase the righting moment. The further away from hull assembly 102, the greater ballast 900 acts to increase the righting moment. Ballast 900 may be configured in a streamlined cross-section to reduce drag, and be constructed of materials having a strong negative buoyancy, such as iron, lead or steel. In another embodiment, ballast 400 is largely hollow and coupled directly to hull assembly 102, typically underneath, and its buoyancy controlled by either introducing water or air into ballast 900, as commonly known in the submarine arts.

Figure 10:
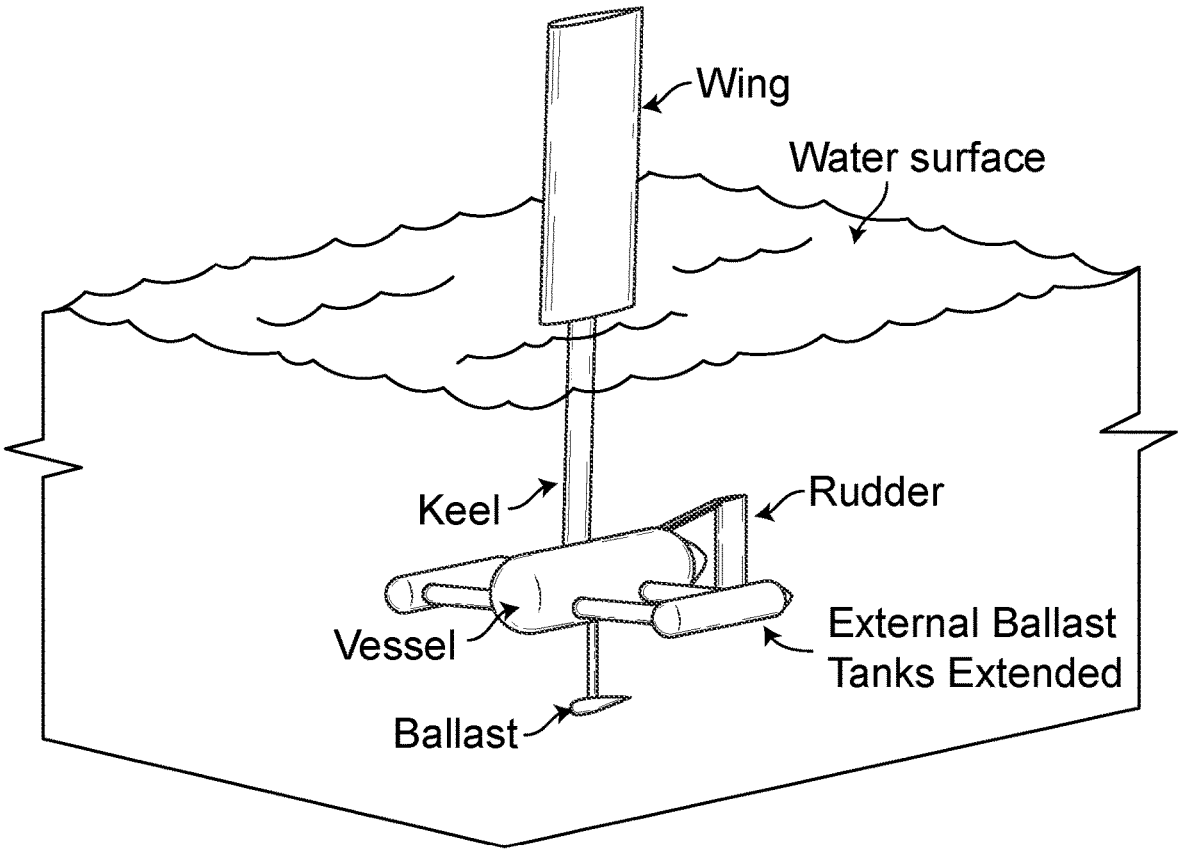
FIG. 10 illustrates another embodiment of the submerged sailing vessel of FIG. 1, having a pair of ballast tanks coupled laterally to the hull assembly via a pair of struts.

In related embodiment, as shown in FIG. 10, a pair of ballast tanks 600 are coupled laterally to hull assembly 102 via a pair of struts 1002, respectively. In this embodiment, the ballast tanks 600 may be filled with water as gas is allowed to escape each tank through a respective pressure value, opened automatically or by personal inside hull assembly 102 via one or more conduits, wires, tubes mounted through or external to each of the struts in connection with one or more motors, gears, pulleys, etc., as well known in the art. As the tanks fill with water, SSV 100 sinks. Conversely, SSV 100 may be forced to the surface of the water as the tanks are filled with compressed air from one or more tanks inside/external to hull assembly 102, or one or more pumps. Increased stability of SSV 100 is achieved by the presence of the ballast tanks 1000. Stability is affected as the length of the struts 1002 are shortened or lengthened, in an embodiment where the length of the struts 1002 are configurable.

Returning to FIG. 9, propulsion assembly 904 is used to propel SSV 100 through the water using techniques well-known in the art, when there is little or no wind to propel SSV 100, or when additional power is desired when SSV 100 is being propelled by the wind. SSV 100 may be steered via the use of rudder 906, using techniques also well-known in the art. Control of propulsion assembly 904 and rudder 906 may be performed manually by crew aboard hull assembly 102, may be performed autonomously using equipment onboard hull assembly 102 (such as a GPS system, one or more motors, actuators, etc.) or may be performed remotely using radio control, also well-known in the art. The power for propulsion may come from one or more common source, such as battery, fuel, fuel cell, etc.

Figure 11:
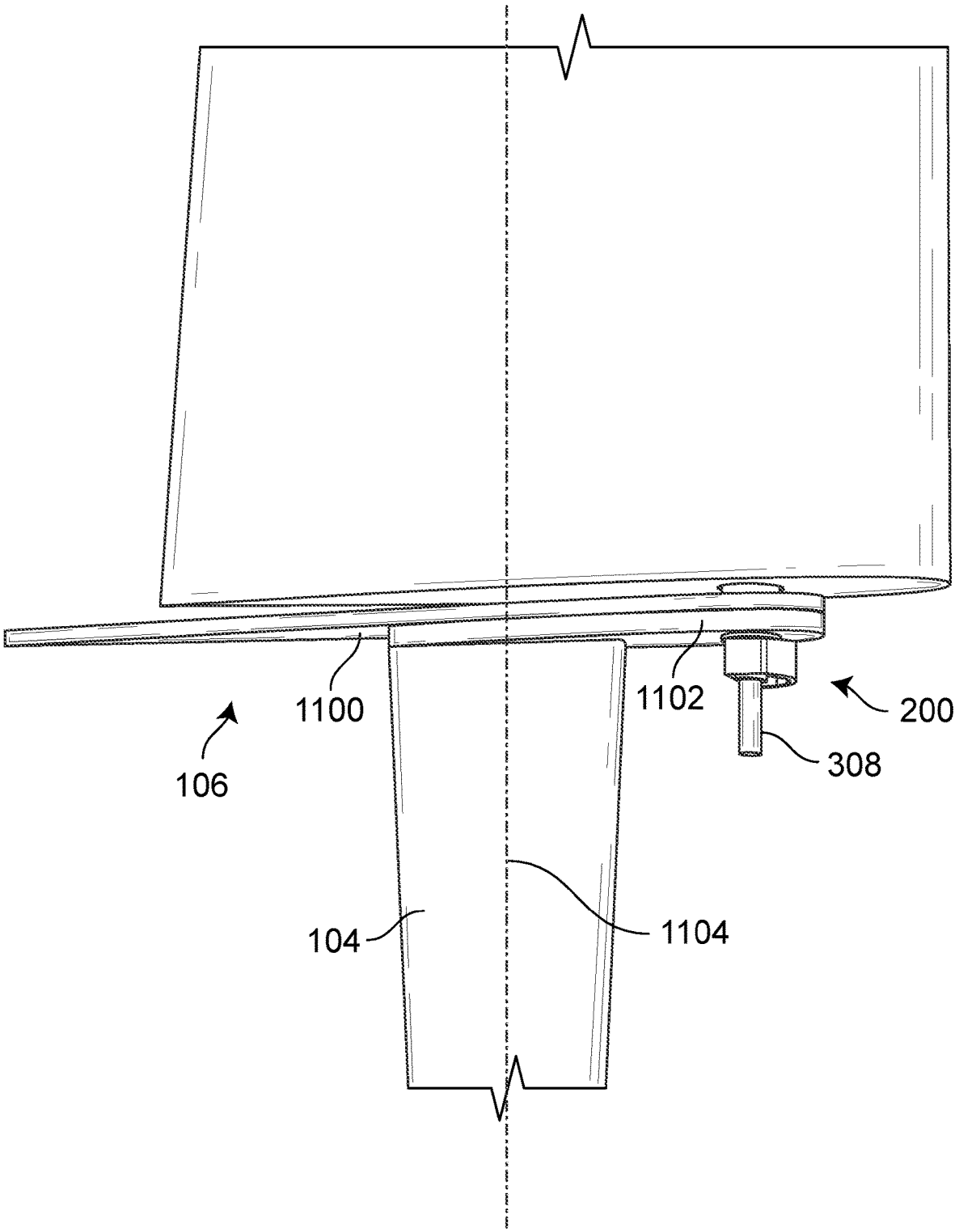
FIG. 11 illustrates another embodiment of the submerged sailing vessel of FIG. 1, comprising a solar array mounted on top of platform that is in turn mounted to the top of a keel of the submerged sailing vessel of FIG. 1.

FIG. 11 illustrates another embodiment of SSV 100, comprising a solar array 1100 mounted on top of platform 1102 that is in turn mounted to the top of keel 104. It should be understood that platform 1102 may be used to interconnect wind-catching assembly 106 with keel 104 without the use of solar array 1100. The platform 1102 may be sized in order to accommodate a quantity of solar cells needed to power one or more electrical systems or components disposed in or on hull assembly 102. In this embodiment, solar array 1100 produces electricity that is provided to hull assembly 102 via electric cables (not shown) mounted through keel 104 or externally to keel 104. This generated electricity would be used as described and/or stored in a battery or fuel system. In a related embodiment, wind-catching assembly comprises a flexible solar array, also for providing electricity to hull assembly 104. Such flexible solar arrays are readily available in the marketplace. The power generated by solar array 1100 and/or the flexible solar array may be used to power a propeller or other propulsion system, lights, communication systems, navigation systems, surveillance systems, science instrumentation, collision avoidance, or other electronics devices or systems onboard SSV 100.

The platform 1102 may also be designed to offset the mast 308 from a keel centerline 1104, i.e., by positioning a mast through-hole fore of a connection point between keel 104 and platform 1102. It is well known in the art of naval architecture and yacht design that in order for a vessel to sail reasonably well or at all, the sideforce generated by the keel, hull, and rudder combination counteracts the sideforce generated a wind-catching mechanism. In addition, the moment created by the aerodynamic sideforce (from by the wind catching mechanism) and the hydrodynamic sideforce (created by the keel/hull/rudder assembly) about the vertical axis of the vessel must balance. In other words, the fore and aft location of the center of pressure of the wind catching mechanism and the center of effort of the hydrodynamic portion of the vessel must align. In practice, this is accomplished by careful design of the physical positions and sizes of the various components, and in operation is trimmed by use and control of the rudder which, when rotated, provides a variable amount of sideforce at its location on the vessel that, in turn, adds or subtracts from the hydrodynamic side of the moment equation, thus creating the required sideforce and moment balance. In a practical and typical design, the center of effort of the wing is placed forward of the center of effort of the keel (which is the primary hydrodynamic sideforce-generating element). As described above, this leaves the rudder to generate the remainder of the sideforce and to balance the moment about the vertical axis and provide straight line motion in the desired direction.

As mentioned previously, in some embodiments, keel 104 and/or wind-catching assembly 106 may be configured to be inflatable. In these embodiments, keel 104 and wind-catching assembly 106 may be deflated using one or more pumps, gears, pulleys, etc. so that wind-catching assembly 106 lies flat on or under the water surface, for stealth purposes. Keel 104 and/or wind-catching assembly 106 may be re-inflated when desired, or keel 104 and/or wind-catching assembly 106 may be jettisoned, in an embodiment where keel 104 is detachably coupled to hull assembly 102 and/or wind-catching assembly 106 is detachably coupled to keep 104. In such embodiments, typically a release cable emanating from hull assembly 102 is used as a mechanism to detach either keel 104, wind-catching assembly 106, or both.

In any of the embodiments discussed above, SSV 100 may be as small as a specialized instrumentation vessel or as large as an underwater hotel. In one embodiment, hull assembly 102 is approximately 4 feet long, 4 inches wide and 4 inches tall, keel 104 is 3½ feet long, having a chordlength of approximately 6 inches near hull assembly 102, and 12 inches near wind-catching assembly 106, while wind-catching assembly 106 is approximately 3½ feet high and having a sail or wing that is 3½ feet by 14 inches chordlength. These values dictate the speed, rotational moments, weight, buoyance, and other performance characteristics of SSV 100, and they may be scaled to achieve larger or smaller sized SSVs, and/or vary one or more of the dimensions to meet certain, predefined performance criteria. In larger embodiments, i.e., for carrying passengers and/or a crew, keel 104 may be configured to be hollow and comprise steps, stairs, a ladder or other means to load and unload such passengers and/or crew to/from SSV 100.

Figure 12:
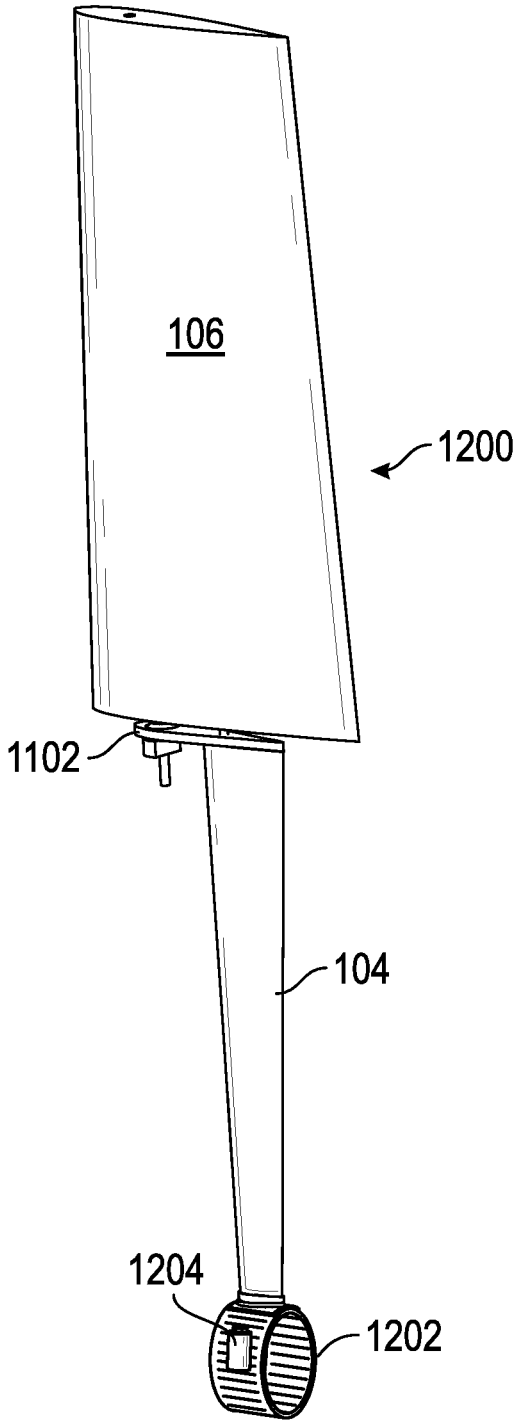
FIG. 12 is a perspective view of one embodiment of a detachable, wind-propulsion apparatus for propelling underwater vessels using the wind.

FIG. 12 is a perspective view of one embodiment of a detachable, wind-propulsion apparatus 1200 for propelling existing under-water vessels using the wind. Note that the relative dimensions of the various parts of apparatus 1200 may not be in proportion to each other as shown in FIG. 12. This embodiment may be particularly useful to retrofit existing under-water drones, submarines, and other vessels that travel primarily under water. Apparatus 1200 comprises keel 104 and wind-catching assembly as shown in FIGS. 1-11, however lacking hull 102. In this way, an existing submersible vessel normally propelled by under-water means, such as an engine in cooperation with a propeller, may be powered, alternatively or in addition to the under-water means of propulsion, by the wind by attaching apparatus 1200 to the existing submersible vessel. In the embodiment shown in FIG. 12, keel 104 is coupled to wind-catching assembly 106 as before (in this embodiment, via platform 1102), and coupling means 1202 is attached to a lower end portion of keel 104.

In this embodiment, coupling means 1202 comprises a large "hose clamp", i.e., a constricting ring structure whose diameter is adjustable via adjustment means 1204. Adjustment means 1204 may comprise a banded screw or a spring. In the case of a banded screw, adjustment means 1204 comprises a grooved band of metal with a screw and a catch. The end of the band slides through the catch, and the screw is turned to tighten the band and constrict the diameter. In other embodiments, coupling means 1202 comprises, simply, a band of metal, plastic, or other flexible or semi-flexible material, sized and shaped to conform to the surface of the existing, under-water vessel. The band typically comprises a joint, or discontinuity and fastening means located at each end of the discontinuity, for allowing the band to be placed around the perimeter of the existing under-water vessel, then clamping the band around the perimeter using the fastening means to fasten each end to one another.

Figure 13:
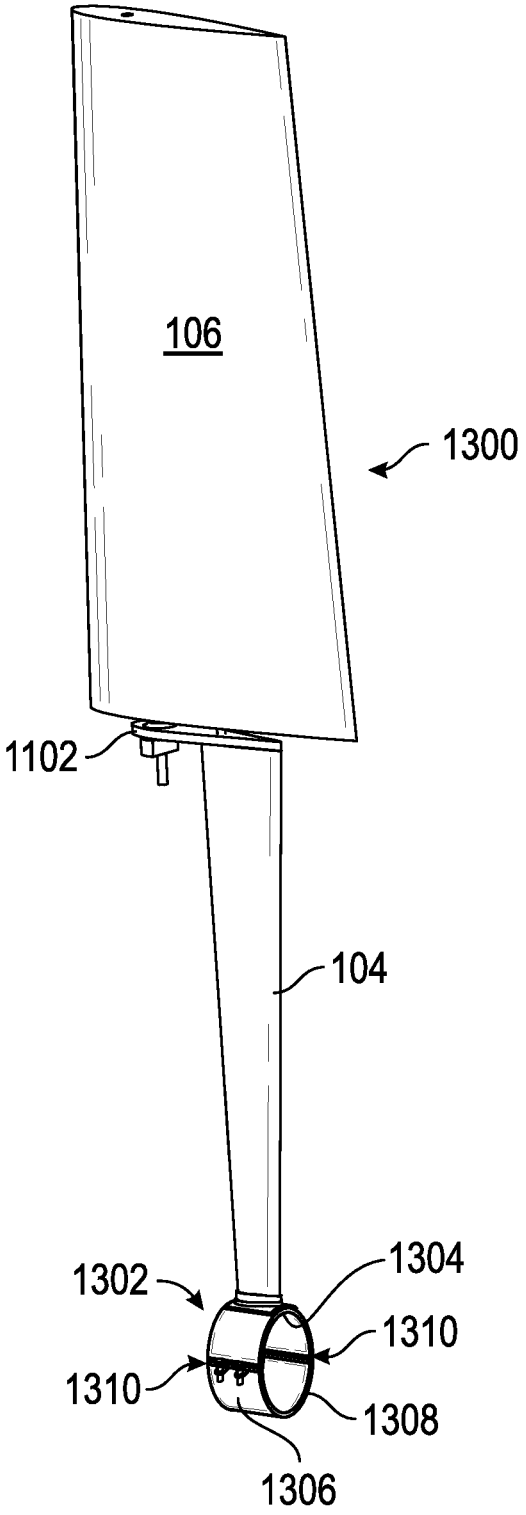
FIG. 13 is perspective view of another embodiment of a detachable, wind-propulsion apparatus for propelling underwater vessels using the wind.

FIG. 13 is a perspective view of another embodiment of a detachable, wind-propulsion apparatus 1300 for propelling existing under-water vessels using the wind, wherein coupling means 1202 comprises a clamp 1302 that replaces the "hose clamp" or bendable band as shown in FIG. 12, made from solid material such as metal, plastic, etc. and comprising a concave, inner surface 1304 sized and shaped to conform generally to the surface of an the existing under-water vessel. Typically, the clamp 1302 comprises at least two sections, a first section 1306 that is coupled to keel 104 and a second section 1308 for placement around the surface of the existing under-water vessel and coupled to the first section via fasteners 1310, such as screws, bolts or some other mechanical coupling means.

In either of the embodiments shown in FIG. 12 or 13, the coupling means 1202 may be detachably coupled to keel 104. This may be a desirable feature in applications where an under-water vessel is not expected to return (as in the case of a torpedo) and/or is required to travel long distances, beyond the range of any under-water propulsion system, or in applications where fuel consumption must be held to a minimum over the course of deployment. In this embodiment, keel 104 may be detachably coupled to coupling means 1202 via, for example, a cotter pin for holding a shaft of coupling means 1202 to a receptacle located on the bottom portion of keel 104. In this example, the cotter pin may be pulled via a release cable emanating from the existing under-water vessel and controlled by manual or remote-control means.

While the foregoing disclosure shows illustrative embodiments of the invention, it should be noted that various changes and modifications could be made herein without departing from the scope of the embodiments as defined by the appended claims. Furthermore, although elements of the invention may be described or claimed in the singular, the plural is contemplated unless limitation to the singular is explicitly stated.

We claim:

1. A submersible sailing vessel, propelled by wind, comprising:

a hull;

means for propelling the submersible sailing vessel through water by the wind while the hull is submerged under the water, thereby generating a rolling moment that acts on the submersible sailing vessel; and means, coupled between the hull and the means for propelling the submersible sailing vessel through the water, for generating a righting moment that acts on the submersible sailing vessel for resisting the rolling moment.

2. The submersible sailing vessel of claim 1, wherein the hull and the means for propelling the submersible sailing vessel through water is negatively buoyant and the means for generating the righting moment comprises an offsetting positive buoyancy resulting in an overall neutral buoyancy of the submersible sailing vessel.

3. The submersible sailing vessel of claim 1, wherein, in operation, the hull and the means for generating the righting moment are submerged under the water as the submersible sailing vessel is propelled by the wind.

4. The submersible sailing vessel of claim 1, wherein the means for propelling the submersible sailing vessel through water produces the rolling moment about a center of buoyancy of the submersible sailing vessel that is located above a center of gravity of the submersible sailing vessel, and the means for generating the righting moment produces a righting moment around the center of buoyancy that resists the rolling moment.

5. The submersible sailing vessel of claim 1, further comprising a passive, automatic wing control mechanism for coupling the means for propelling the submersible sailing vessel to the means for generating the righting moment and for automatically maintaining the means for propelling the submersible sailing vessel at an angle to the wind.

6. The submersible sailing vessel of claim 5, wherein the means for propelling the submersible sailing vessel comprises a mast and a wing, and the passive, automatic wing control mechanism comprises:

a tension bar;

a drum comprising a through hole;

a pivot assembly rotatably coupled to the drum via a hollow tube extension positioned into the through hole and further coupled to a first end of the mast, the pivot assembly further comprising a roller coupled to an arm extending from the hollow extension tube, the roller for engagement with the tension bar as the mast is rotated by the wind against the sail;

wherein the tension bar causes a restoring force against the roller as the roller is displaced from a center point of the drum along a drum perimeter, causing the wing to maintain the angle with respect to the wind.

7. The submersible sailing vessel of claim 1, wherein the means for propelling the submersible sailing vessel comprises an inflatable wing.

8. The submersible sailing vessel of claim 7 further comprising:

a source of compressed gas located on or within the hull; and a supply line coupling the source of compressed gas to the inflatable wing via the means for generating the righting moment;

wherein the inflatable wing is inflated into a fully-inflated state as the compressed gas from the source of compressed gas is provided to the inflatable wing.

9. The submersible sailing vessel of claim 1, further comprising:

a release mechanism coupling the means for propelling the submersible sailing vessel to the means for generating the righting moment, wherein at least part of the means for propelling the submersible sailing vessel is released from the means for generating the righting moment upon activation of the release mechanism.

10. The submersible sailing vessel of claim 1, further comprising:

a release mechanism coupling the means for generating the righting moment to the hull, wherein the means for generating the righting moment and the means for propelling the submersible sailing vessel are released from the hull upon activation of the release mechanism.

11. The submersible sailing vessel of claim 1, further comprising:

a ballast package coupled to the hull for adjusting a buoyancy of the submersible sailing vessel.

12. The submersible sailing vessel of claim 11, further comprising:

an adjustable strut coupling the ballast package to the hull, the adjustable strut for positioning the ballast package closer or further away from the hull.

13. The submersible sailing vessel of claim 1, further comprising:

a ballast tank coupled to the hull;

a source of liquid or compressed gas located on or within the hull; and a supply line coupling the liquid or the compressed gas to the ballast tank;

wherein the ballast tank receives the liquid or the compressed gas from the source of liquid or compressed gas that increases the buoyancy of the submersible sailing vessel when the liquid or compressed gas is released into the ballast tank or decreases the buoyance of the submersible sailing vessel when the liquid or compressed gas is released into the ballast tank.

14. The submersible sailing vessel of claim 1, wherein the hull is sized and shaped to accommodate at least one person.

15. The submersible sailing vessel of claim 1, further comprising:

a platform coupled to a top of the means for generating the righting moment, the platform comprising a hole for receiving a portion of the means for propelling the submersible sailing vessel, for offsetting a mast of the means for propelling the submersible sailing vessel with a longitudinal axis of the means for generating the righting moment.

16. The submersible sailing vessel of claim 15, further comprising:

a solar array coupled to a top of the platform for providing solar power to the submersible sailing vessel.

17. The submersible sailing vessel of claim 1, wherein the means for generating the righting moment comprises means for allowing passengers or crew ingress and egress to the hull.

18. A wind-powered attachment for an under-water vessel, comprising:

a wing sail for propelling the under-water vessel;

a keel coupled to and extending vertically downwards from the wing sail, for generating a righting moment that resists a rolling moment caused by the wind against the wing sail; and means for coupling the keel to the under-water vessel.

19. The wind-powered attachment of claim 18, wherein the means for coupling the keel to the under-water vessel comprises two sections, a first of the two sections coupled to the keel at a point along a convex surface of the first section, and a second of the two sections coupled to the first section via a removable coupling means, forming an opening sized and shaped to a cross-section of the under-water vehicle.

20. The submersible sailing vessel of claim 1, further comprising:

buoyancy-compensation means for positioning the hull at least partially exposed on a water surface; and an engine for propelling the submersible sailing vessel on the water surface.

* * * * *